US012331465B2

(12) United States Patent
Qin et al.

(10) Patent No.: US 12,331,465 B2
(45) Date of Patent: Jun. 17, 2025

(54) FOAM-FORMED FIBROUS SHEETS WITH CRIMPED STAPLE FIBERS

(71) Applicant: Kimberly-Clark Worldwide, Inc., Neenah, WI (US)

(72) Inventors: Jian Qin, Appleton, WI (US); Deborah J. Calewarts, Winneconne, WI (US); Charles W. Colman, Marietta, GA (US); Donald E. Waldroup, Roswell, GA (US); Cathleen M. Uttecht, Menasha, WI (US); Peter Wallace, Penzance (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 16/608,471

(22) PCT Filed: Apr. 28, 2017

(86) PCT No.: PCT/US2017/030038
§ 371 (c)(1),
(2) Date: Oct. 25, 2019

(87) PCT Pub. No.: WO2018/199975
PCT Pub. Date: Nov. 1, 2018

(65) Prior Publication Data
US 2020/0190739 A1 Jun. 18, 2020

(51) Int. Cl.
*D21H 15/10* (2006.01)
*D01D 5/22* (2006.01)
(Continued)

(52) U.S. Cl.
CPC ..... *D21H 15/10* (2013.01); *D01D 5/22* (2013.01); *D21F 11/002* (2013.01); *D21H 13/10* (2013.01); *D21H 15/04* (2013.01); *D21H 27/005* (2013.01)

(58) Field of Classification Search
CPC ..... D21H 15/04; D21H 13/10; D21H 21/56; D21H 27/00; D21H 15/10; D21H 27/005;
(Continued)

(56) References Cited

U.S. PATENT DOCUMENTS 2,105,711 A 1/1938 Weathered
2,791,523 A 5/1957 Schoen
(Continued)

FOREIGN PATENT DOCUMENTS

AT 517303 A1 12/2016
AT 519414 A2 6/2018
(Continued)

*Primary Examiner* — Jose A Fortuna
(74) *Attorney, Agent, or Firm* — KIMBERLY-CLARK WORLDWIDE, INC.

(57) ABSTRACT

A method for producing a high-bulk, foam-formed substrate includes producing an aqueous-based foam including at least 1% by weight crimped synthetic fibers and at least 1% by weight binder fibers; forming a wet sheet from the aqueous-based foam; and drying the wet sheet to obtain the foam-formed substrate. A substrate includes an aqueous-based polymer foam including at least 1% by weight crimped synthetic fiber and at least 1% by weight binder fiber, wherein the substrate is free of superabsorbent material. A method for producing a high-bulk, foam-formed substrate includes producing an aqueous-based foam including at least 2% by weight crimped binder fibers; forming a wet sheet from the aqueous-based foam; and drying the wet sheet to obtain the foam-formed substrate, wherein the foam-formed substrate is free of superabsorbent material, and wherein the substrate has a dry density between 0.02 g/cc and 0.1 g/cc.

14 Claims, 6 Drawing Sheets

(51) Int. Cl.

| | |
|---|---|
| ***D21F 11/00*** | (2006.01) |
| ***D21H 13/10*** | (2006.01) |
| ***D21H 15/04*** | (2006.01) |
| ***D21H 27/00*** | (2006.01) |

(58) Field of Classification Search

CPC ..... D21H 27/002; D21H 13/00; D21H 15/02; D21F 11/002; D01D 5/22; D01D 5/253; A47K 10/16

See application file for complete search history.

(56) References Cited

U.S. PATENT DOCUMENTS 3,007,840 A * 11/1961 Wilcox ..... D21F 11/002 162/101
3,506,538 A 4/1970 Friedberg et al.
3,542,640 A 11/1970 Friedberg et al.
3,615,975 A 10/1971 Gillern et al.
3,716,449 A 2/1973 Gatward et al.
3,798,122 A 3/1974 Appel
3,837,999 A 9/1974 Chung
3,839,142 A 10/1974 Clarke et al.
3,871,952 A 3/1975 Robertson
3,929,560 A 12/1975 Holik et al.
3,938,782 A 2/1976 Robertson
3,966,540 A 6/1976 Selander et al.
4,007,083 A 2/1977 Ring et al.
4,049,491 A 9/1977 Brandon et al.
4,062,721 A 12/1977 Guyer et al.
4,123,787 A 10/1978 Leclerc du Sablon et al.
4,200,488 A 4/1980 Brandon et al.
4,285,767 A 8/1981 Page
4,288,475 A 9/1981 Meeker
4,299,655 A 11/1981 Skaugen
4,394,930 A 7/1983 Korpman
4,415,388 A 11/1983 Korpman
4,443,232 A 4/1984 Kaiser
4,443,297 A 4/1984 Cheshire et al.
4,443,299 A 4/1984 Cheshire et al.
4,464,224 A 8/1984 Matolcsy
4,478,615 A 10/1984 Kaiser
4,483,976 A * 11/1984 Yamamoto ..... D01F 6/86 528/275
4,488,932 A 12/1984 Eber et al.
4,498,956 A 2/1985 Cheshire et al.
4,543,156 A 9/1985 Cheshire et al.
4,613,627 A 9/1986 Sherman et al.
4,650,479 A 3/1987 Insley
4,655,950 A 4/1987 Michalek
4,686,006 A 8/1987 Cheshire et al.
4,734,321 A 3/1988 Radvan et al.
4,764,253 A 8/1988 Cheshire et al.
4,773,408 A 9/1988 Cilento et al.
4,773,409 A 9/1988 Cilento et al.
4,778,477 A 10/1988 Lauchenauer
4,883,478 A 11/1989 Lerailler et al.
4,939,030 A 7/1990 Tsuji et al.
4,944,843 A 7/1990 Wallace et al.
4,948,007 A 8/1990 Berg et al.
4,952,448 A 8/1990 Bullock et al.
4,969,975 A 11/1990 Biggs et al.
4,973,382 A 11/1990 Kinn et al.
4,985,467 A 1/1991 Kelly et al.
5,006,373 A 4/1991 Woodmansee et al.
5,008,306 A 4/1991 Goguelin
5,013,405 A 5/1991 Izard
5,064,653 A 11/1991 Sessions et al.
5,065,752 A 11/1991 Sessions et al.
5,073,416 A 12/1991 Avakian et al.
5,098,778 A 3/1992 Minnick
5,102,501 A * 4/1992 Eber ..... D21C 9/007 162/111
5,134,959 A 8/1992 Woodmansee et al.
5,137,551 A 8/1992 Ahrens et al.
5,147,345 A 9/1992 Young et al.
5,153,058 A 10/1992 Hall et al.
5,164,045 A 11/1992 Awofeso et al.
5,178,729 A 1/1993 Janda
5,196,090 A 3/1993 Corbellini et al.
5,200,035 A 4/1993 Bhat et al.
5,227,023 A 7/1993 Pounder et al.
5,238,534 A 8/1993 Manning et al.
5,260,017 A 11/1993 Giles
5,260,345 A 11/1993 DesMarais et al.
5,268,224 A 12/1993 DesMarais et al.
5,300,565 A 4/1994 Berg et al.
5,308,565 A 5/1994 Weber et al.
5,318,554 A 6/1994 Young et al.
5,328,935 A 7/1994 Van Phan et al.
5,330,822 A 7/1994 Berg et al.
5,331,015 A 7/1994 DesMarais et al.
5,338,766 A 8/1994 Phan et al.
5,344,866 A 9/1994 Hall
5,348,453 A 9/1994 Baran et al.
5,369,007 A 11/1994 Kidwell
5,372,766 A 12/1994 Roe
5,384,179 A 1/1995 Roe et al.
5,387,207 A 2/1995 Dyer et al.
5,393,379 A 2/1995 Parrinello
5,397,316 A 3/1995 LaVon et al.
5,397,626 A 3/1995 Berg et al.
5,409,572 A 4/1995 Kershaw et al.
5,428,076 A 6/1995 Roe
5,434,194 A 7/1995 Fujimoto et al.
5,451,452 A 9/1995 Phan et al.
5,468,437 A 11/1995 Hall
5,486,167 A 1/1996 Dragoo et al.
5,506,046 A 4/1996 Andersen et al.
5,506,277 A 4/1996 Griesbach
5,508,072 A 4/1996 Andersen et al.
5,533,244 A 7/1996 Wadzinski
5,536,264 A 7/1996 Hsueh et al.
5,545,450 A 8/1996 Andersen et al.
5,549,589 A 8/1996 Horney et al.
5,550,167 A 8/1996 DesMarais
5,560,878 A 10/1996 Dragoo et al.
5,562,646 A 10/1996 Goldman et al.
5,563,179 A 10/1996 Stone et al.
D375,633 S 11/1996 Spanagel et al.
5,571,849 A 11/1996 DesMarais
5,580,624 A 12/1996 Andersen et al.
5,582,670 A 12/1996 Andersen et al.
5,585,432 A 12/1996 Lee et al.
5,586,842 A 12/1996 Bae et al.
5,599,334 A 2/1997 Johnston et al.
5,612,385 A 3/1997 Ceaser et al.
D378,876 S 4/1997 Spanagel et al.
5,618,341 A 4/1997 Andersen et al.
5,624,971 A 4/1997 Wilson
5,626,857 A 5/1997 Thimineur et al.
5,631,053 A 5/1997 Andersen et al.
5,632,737 A 5/1997 Stone et al.
5,633,291 A 5/1997 Dyer et al.
5,649,409 A 7/1997 Gujer et al.
5,650,222 A 7/1997 DesMarais et al.
D381,810 S 8/1997 Schultz et al.
5,658,603 A 8/1997 Andersen et al.
5,660,900 A 8/1997 Andersen et al.
5,660,903 A 8/1997 Andersen et al.
5,660,904 A 8/1997 Andersen et al.
5,662,731 A 9/1997 Andersen et al.
5,665,442 A 9/1997 Andersen et al.
5,674,917 A 10/1997 Wilson
5,679,145 A 10/1997 Andersen et al.
5,679,218 A 10/1997 Vinson et al.
5,683,772 A 11/1997 Andersen et al.
5,691,014 A 11/1997 Andersen et al.
5,692,939 A 12/1997 DesMarais
5,693,403 A 12/1997 Brown et al.
5,695,607 A 12/1997 Oriaran et al.
5,702,571 A 12/1997 Kamps et al.
5,705,203 A 1/1998 Andersen et al.
5,705,238 A 1/1998 Andersen et al.
5,705,239 A 1/1998 Andersen et al.

(56) References Cited

U.S. PATENT DOCUMENTS

| | | | |
|---|---|---|---|
| 5,705,242 | A | 1/1998 | Andersen et al. |
| 5,707,474 | A | 1/1998 | Andersen et al. |
| 5,707,579 | A | 1/1998 | Habelski et al. |
| 5,709,827 | A | 1/1998 | Andersen et al. |
| 5,709,913 | A | 1/1998 | Andersen et al. |
| D390,363 | S | 2/1998 | Baum et al. |
| 5,713,881 | A | 2/1998 | Rezai et al. |
| 5,716,563 | A | 2/1998 | Winterowd et al. |
| 5,716,675 | A | 2/1998 | Andersen et al. |
| 5,719,201 | A | 2/1998 | Wilson |
| 5,720,851 | A | 2/1998 | Reiner |
| 5,728,743 | A | 3/1998 | Dyer et al. |
| 5,736,209 | A | 4/1998 | Andersen et al. |
| 5,741,581 | A | 4/1998 | DesMarais et al. |
| 5,744,506 | A | 4/1998 | Goldman et al. |
| 5,744,509 | A | 4/1998 | Wilson et al. |
| 5,753,308 | A | 5/1998 | Andersen et al. |
| 5,753,359 | A | 5/1998 | Dyer et al. |
| 5,763,499 | A | 6/1998 | DesMarais |
| 5,770,634 | A | 6/1998 | Dyer et al. |
| 5,776,388 | A | 7/1998 | Andersen et al. |
| 5,783,126 | A | 7/1998 | Andersen et al. |
| 5,795,921 | A | 8/1998 | Dyer et al. |
| 5,800,416 | A | 9/1998 | Seger et al. |
| 5,800,647 | A | 9/1998 | Andersen et al. |
| 5,810,961 | A | 9/1998 | Andersen et al. |
| 5,817,703 | A | 10/1998 | Blair et al. |
| 5,830,305 | A | 11/1998 | Andersen et al. |
| 5,843,055 | A | 12/1998 | Seger |
| 5,843,544 | A | 12/1998 | Andersen et al. |
| 5,849,155 | A | 12/1998 | Gasland |
| 5,849,805 | A | 12/1998 | Dyer |
| 5,851,634 | A | 12/1998 | Andersen et al. |
| 5,851,648 | A | 12/1998 | Stone et al. |
| 5,853,402 | A | 12/1998 | Faulks et al. |
| 5,863,958 | A | 1/1999 | Dyer et al. |
| 5,868,724 | A | 2/1999 | Dierckes et al. |
| 5,876,643 | A | 3/1999 | Biggs et al. |
| 5,879,722 | A | 3/1999 | Andersen et al. |
| 5,882,479 | A | 3/1999 | Oriaran et al. |
| 5,891,119 | A | 4/1999 | Ta et al. |
| 5,899,893 | A | 5/1999 | Dyer et al. |
| 5,900,114 | A | 5/1999 | Brown et al. |
| 5,904,809 | A | 5/1999 | Rokman et al. |
| 5,904,812 | A | 5/1999 | Salman et al. |
| 5,908,533 | A | 6/1999 | Marinack et al. |
| 5,916,503 | A | 6/1999 | Rettenbacher |
| 5,916,928 | A | 6/1999 | Sessions et al. |
| 5,919,411 | A | 7/1999 | Rezai et al. |
| 5,922,780 | A | 7/1999 | Dyer et al. |
| 5,925,299 | A | 7/1999 | Dierckes et al. |
| 5,928,741 | A | 7/1999 | Andersen et al. |
| 5,948,829 | A | 9/1999 | Wallajapet et al. |
| 5,958,186 | A | 9/1999 | Holm et al. |
| 5,976,235 | A | 11/1999 | Andersen et al. |
| 5,985,434 | A | 11/1999 | Qin et al. |
| 6,001,218 | A | 12/1999 | Hsu et al. |
| 6,013,293 | A | 1/2000 | De Moor |
| 6,013,589 | A | 1/2000 | DesMarais et al. |
| 6,017,833 | A | 1/2000 | Reiner et al. |
| 6,019,871 | A | 2/2000 | Rokman et al. |
| 6,022,615 | A | 2/2000 | Rettenbacher |
| 6,027,610 | A | 2/2000 | Back et al. |
| 6,030,673 | A | 2/2000 | Andersen et al. |
| 6,037,282 | A | 3/2000 | Milding et al. |
| D423,232 | S | 4/2000 | Reid |
| 6,051,104 | A | 4/2000 | Oriaran et al. |
| 6,054,022 | A | 4/2000 | Helwig et al. |
| 6,074,527 | A | 6/2000 | Hsu et al. |
| 6,077,390 | A | 6/2000 | Salman et al. |
| 6,077,590 | A | 6/2000 | Archer et al. |
| 6,083,211 | A | 7/2000 | DesMarais |
| 6,083,586 | A | 7/2000 | Andersen et al. |
| 6,086,718 | A | 7/2000 | Carter et al. |
| 6,090,195 | A | 7/2000 | Andersen et al. |
| 6,093,359 | A | 7/2000 | Gauchel et al. |
| 6,096,809 | A | 8/2000 | Lorcks et al. |
| 6,103,060 | A | 8/2000 | Munerelle et al. |
| 6,103,063 | A | 8/2000 | Oriaran et al. |
| D430,406 | S | 9/2000 | Ingalls |
| D430,407 | S | 9/2000 | Ingalls |
| D430,734 | S | 9/2000 | Bredendick et al. |
| 6,113,740 | A | 9/2000 | Oriaran et al. |
| D431,371 | S | 10/2000 | Ingalls et al. |
| D431,372 | S | 10/2000 | Ingalls et al. |
| 6,133,193 | A | 10/2000 | Kajikawa et al. |
| 6,136,153 | A | 10/2000 | Rokman et al. |
| 6,136,873 | A | 10/2000 | Hahnle et al. |
| 6,153,053 | A | 11/2000 | Harper et al. |
| 6,160,028 | A | 12/2000 | Dyer |
| 6,162,961 | A | 12/2000 | Tanner et al. |
| 6,163,943 | A | 12/2000 | Johansson et al. |
| D436,738 | S | 1/2001 | Bredendick et al. |
| 6,168,857 | B1 | 1/2001 | Andersen et al. |
| 6,174,152 | B1 | 1/2001 | Rokman et al. |
| 6,174,929 | B1 | 1/2001 | Hähnle et al. |
| D437,119 | S | 2/2001 | Jahner et al. |
| D437,120 | S | 2/2001 | Jahner et al. |
| D437,489 | S | 2/2001 | Jahner et al. |
| D438,017 | S | 2/2001 | Reid |
| 6,193,838 | B1 | 2/2001 | Oriaran et al. |
| 6,200,404 | B1 | 3/2001 | Andersen et al. |
| 6,203,663 | B1 | 3/2001 | Kamps et al. |
| 6,207,244 | B1 | 3/2001 | Hesch |
| D440,051 | S | 4/2001 | Bredendick et al. |
| 6,214,274 | B1 | 4/2001 | Melius et al. |
| 6,214,907 | B1 | 4/2001 | Tomka |
| 6,231,960 | B1 | 5/2001 | Dyer et al. |
| 6,231,970 | B1 | 5/2001 | Andersen et al. |
| 6,235,816 | B1 | 5/2001 | Lorcks et al. |
| 6,238,518 | B1 | 5/2001 | Rokman et al. |
| D443,766 | S | 6/2001 | Bredendick et al. |
| 6,243,934 | B1 | 6/2001 | Wadzinski |
| 6,245,410 | B1 | 6/2001 | Hähnle et al. |
| 6,245,697 | B1 | 6/2001 | Conrad et al. |
| 6,248,211 | B1 | 6/2001 | Jennings et al. |
| 6,251,207 | B1 | 6/2001 | Schultz et al. |
| 6,258,203 | B1 | 7/2001 | Rokman et al. |
| 6,261,679 | B1 | 7/2001 | Chen et al. |
| 6,274,077 | B1 | 8/2001 | Hur et al. |
| 6,280,570 | B1 | 8/2001 | Harper et al. |
| 6,287,417 | B1 | 9/2001 | Bhat |
| 6,287,422 | B1 | 9/2001 | Harper et al. |
| 6,296,736 | B1 | 10/2001 | Hsu et al. |
| 6,296,929 | B1 | 10/2001 | Gentile et al. |
| 6,309,661 | B1 | 10/2001 | Haynes et al. |
| 6,355,142 | B1 | 3/2002 | Ahrens |
| 6,372,087 | B2 | 4/2002 | Harper et al. |
| 6,376,032 | B1 | 4/2002 | Clarke et al. |
| 6,387,210 | B1 | 5/2002 | Hsu et al. |
| D459,897 | S | 7/2002 | Bredendick et al. |
| 6,413,368 | B1 | 7/2002 | Dwiggins et al. |
| 6,419,790 | B1 | 7/2002 | Leege et al. |
| 6,425,983 | B1 | 7/2002 | Marinack et al. |
| 6,432,272 | B1 | 8/2002 | Hollenberg et al. |
| 6,436,234 | B1 | 8/2002 | Chen et al. |
| 6,440,266 | B1 | 8/2002 | George et al. |
| 6,443,258 | B1 | 9/2002 | Putt et al. |
| 6,444,088 | B2 | 9/2002 | Rökman et al. |
| 6,447,640 | B1 | 9/2002 | Watson et al. |
| 6,451,166 | B1 | 9/2002 | Marinack et al. |
| 6,455,600 | B1 | 9/2002 | Hähnle et al. |
| 6,472,497 | B2 | 10/2002 | Loercks et al. |
| 6,500,302 | B2 | 12/2002 | Dwiggins et al. |
| 6,503,372 | B1 | 1/2003 | Rokman et al. |
| 6,518,479 | B1 | 2/2003 | Graef et al. |
| 6,525,240 | B1 | 2/2003 | Graef et al. |
| 6,527,913 | B1 | 3/2003 | Johnson et al. |
| 6,531,078 | B2 | 3/2003 | Laine et al. |
| 6,540,879 | B2 | 4/2003 | Marinack et al. |
| 6,544,386 | B1 | 4/2003 | Krzysik et al. |
| 6,548,132 | B1 | 4/2003 | Clarke et al. |
| 6,562,193 | B1 | 5/2003 | Elonen et al. |
| 6,589,634 | B2 | 7/2003 | Schultz et al. |

(56) References Cited

U.S. PATENT DOCUMENTS 6,596,389 B1 7/2003 Hallett et al.
6,600,086 B1 7/2003 Mace et al.
6,603,054 B2 8/2003 Chen et al.
6,613,424 B1 9/2003 Putt et al.
6,616,802 B1 9/2003 Kinsley, Jr. et al.
6,630,054 B1 10/2003 Graef et al.
6,649,025 B2 11/2003 Mills et al.
6,657,101 B1 12/2003 Malmgren et al.
6,663,611 B2 12/2003 Blaney et al.
6,670,522 B1 12/2003 Graef et al.
6,673,980 B1 1/2004 Varona et al.
6,673,983 B1 1/2004 Graef et al.
6,682,215 B2 1/2004 Kinsley, Jr. et al.
6,689,934 B2 2/2004 Dodge, II et al.
6,703,330 B1 3/2004 Marsh
6,706,944 B2 3/2004 Qin et al.
6,709,548 B2 3/2004 Marinack et al.
6,709,550 B2 3/2004 Holz et al.
6,733,631 B2 5/2004 Elonen et al.
6,734,335 B1 5/2004 Graef et al.
6,746,570 B2 6/2004 Burazin et al.
6,749,719 B2 6/2004 Burazin et al.
6,750,262 B1 6/2004 Hähnle et al.
6,752,907 B2 6/2004 Edwards et al.
6,780,356 B1 8/2004 Putt et al.
6,787,000 B2 9/2004 Burazin et al.
6,790,314 B2 9/2004 Burazin et al.
6,797,114 B2 9/2004 Hu
6,808,790 B2 10/2004 Chen et al.
6,821,385 B2 11/2004 Burazin et al.
6,821,387 B2 11/2004 Hu
6,821,388 B2 11/2004 Marsh
6,824,650 B2 11/2004 Lindsay et al.
6,830,656 B2 12/2004 Kinsley, Jr.
6,837,956 B2 1/2005 Cowell et al.
6,837,972 B2 1/2005 Marsh
6,861,477 B2 3/2005 Wang et al.
6,867,346 B1 3/2005 Dopps et al.
6,875,315 B2 4/2005 Bakken et al.
6,878,238 B2 4/2005 Bakken et al.
6,887,348 B2 5/2005 Hermans et al.
6,893,535 B2 5/2005 Hermans et al.
6,921,459 B2 7/2005 Kinsley, Jr. et al.
6,924,030 B2 * 8/2005 Kamada ..... D01D 5/253 264/185
6,939,914 B2 9/2005 Qin et al.
6,946,058 B2 9/2005 Hu
6,951,598 B2 10/2005 Flugge et al.
6,956,009 B2 10/2005 Wang et al.
6,962,645 B2 11/2005 Graef et al.
6,964,725 B2 11/2005 Shannon et al.
6,969,781 B2 11/2005 Graef et al.
6,983,821 B2 1/2006 Putt et al.
D517,816 S 3/2006 Dwiggins et al.
D519,739 S 5/2006 Schuh et al.
7,041,196 B2 5/2006 Lorenz et al.
7,045,026 B2 5/2006 Lorenz et al.
7,052,580 B2 5/2006 Trokhan et al.
7,066,006 B2 6/2006 Minerath, III et al.
7,067,038 B2 6/2006 Trokhan et al.
7,081,559 B2 7/2006 Fujikawa et al.
7,125,470 B2 10/2006 Graef et al.
7,138,561 B2 11/2006 Fuchs et al.
7,141,142 B2 11/2006 Burazin et al.
7,155,991 B2 1/2007 Minerath, III et al.
7,156,954 B2 1/2007 Farrington, Jr. et al.
7,160,418 B2 1/2007 Edwards et al.
7,166,190 B2 1/2007 Graef et al.
7,169,451 B2 1/2007 Clarke et al.
7,214,293 B2 5/2007 Trokhan et al.
7,220,821 B2 5/2007 Hähnle et al.
7,229,528 B2 6/2007 Vinson et al.
7,235,708 B2 6/2007 Guidotti et al.
D551,406 S 9/2007 Caruso et al.
7,285,183 B2 10/2007 Kajander et al.
7,287,650 B2 10/2007 Koslow
7,291,382 B2 11/2007 Krueger et al.
7,294,238 B2 11/2007 Bakken et al.
7,300,547 B2 11/2007 Luu et al.
7,311,800 B2 12/2007 Russell et al.
7,314,663 B2 1/2008 Stelljes, Jr. et al.
7,314,664 B2 1/2008 Stelljes, Jr. et al.
7,314,665 B2 1/2008 Stelljes, Jr. et al.
7,322,970 B2 1/2008 Schmidt et al.
7,354,502 B2 4/2008 Polat et al.
7,364,015 B2 4/2008 Englert et al.
7,374,638 B2 5/2008 Horenziak et al.
7,390,378 B2 6/2008 Carels et al.
7,396,436 B2 7/2008 Trokhan et al.
7,407,560 B2 8/2008 Hilbig et al.
7,413,629 B2 8/2008 Fisher et al.
7,416,637 B2 8/2008 Murray et al.
7,435,266 B2 10/2008 Sun et al.
7,435,313 B2 10/2008 Boatman et al.
7,435,316 B2 10/2008 Boatman et al.
7,452,834 B2 * 11/2008 Nagahara ..... D04H 1/498 442/385
7,494,563 B2 2/2009 Edwards et al.
7,497,923 B2 3/2009 Ward et al.
7,497,925 B2 3/2009 Hermans et al.
7,497,926 B2 3/2009 Hermans et al.
7,503,998 B2 3/2009 Murray et al.
7,524,399 B2 4/2009 Hermans et al.
7,524,404 B2 4/2009 Boatman et al.
7,585,388 B2 9/2009 Yeh et al.
7,585,389 B2 9/2009 Yeh et al.
7,597,777 B2 10/2009 Wilke, II
7,601,374 B2 10/2009 Clarke
7,629,043 B2 12/2009 Lindsay et al.
7,645,359 B2 1/2010 Lorenz et al.
7,662,257 B2 2/2010 Edwards et al.
7,670,457 B2 3/2010 Murray et al.
7,678,229 B2 3/2010 Wilke, II
7,678,231 B2 * 3/2010 Dyer ..... D21H 21/146 162/168.1
7,682,697 B2 3/2010 Raghavendran et al.
7,691,228 B2 4/2010 Edwards et al.
7,699,959 B2 4/2010 Ward et al.
7,744,576 B2 6/2010 Busam et al.
7,750,203 B2 7/2010 Becker et al.
7,775,958 B2 8/2010 Mukai et al.
7,785,696 B2 8/2010 Boatman et al.
7,794,565 B2 9/2010 Shannon et al.
7,799,161 B2 9/2010 Schuh et al.
7,799,968 B2 9/2010 Chen et al.
7,820,008 B2 10/2010 Edwards et al.
7,828,932 B2 11/2010 Hermans et al.
7,846,296 B2 12/2010 Luu et al.
7,850,823 B2 12/2010 Chou et al.
7,851,057 B2 12/2010 Englert et al.
7,851,667 B2 12/2010 Becker et al.
7,857,941 B2 12/2010 Ruthven et al.
7,862,686 B2 1/2011 Ward et al.
7,887,676 B2 2/2011 Boatman et al.
7,918,951 B2 4/2011 Lorenz et al.
7,918,964 B2 4/2011 Edwards et al.
7,918,972 B2 4/2011 Boatman et al.
7,927,456 B2 4/2011 Murray et al.
7,972,476 B2 7/2011 Scherb et al.
7,994,079 B2 8/2011 Chen et al.
8,007,640 B2 8/2011 Boatman et al.
8,017,827 B2 9/2011 Hundorf et al.
8,056,733 B2 11/2011 Koslow
8,083,893 B2 12/2011 Boatman et al.
8,092,848 B2 1/2012 Clarke
8,102,275 B2 1/2012 McGuire et al.
8,105,301 B2 1/2012 Baer et al.
8,110,232 B2 2/2012 Clarke
8,123,905 B2 2/2012 Luu et al.
8,142,612 B2 3/2012 Murray et al.
8,142,617 B2 3/2012 Ruthven et al.
8,143,472 B1 3/2012 Bragd et al.
8,152,957 B2 4/2012 Edwards et al.
8,152,958 B2 4/2012 Super et al.

(56) References Cited

U.S. PATENT DOCUMENTS 8,158,689 B2 4/2012 Baker et al.
8,178,025 B2 5/2012 Awofeso et al.
8,187,240 B2 5/2012 Busam et al.
8,187,427 B2 5/2012 Schuh et al.
8,211,078 B2 7/2012 Noel
8,226,797 B2 7/2012 Murray et al.
8,257,552 B2 9/2012 Edwards et al.
8,293,072 B2 10/2012 Super et al.
8,319,005 B2 11/2012 Becker et al.
8,324,446 B2 12/2012 Wang et al.
8,328,985 B2 12/2012 Edwards et al.
8,361,278 B2 1/2013 Fike et al.
8,378,000 B2 2/2013 Hintz et al.
8,388,803 B2 3/2013 Super et al.
8,388,804 B2 3/2013 Super et al.
8,394,236 B2 3/2013 Edwards et al.
8,398,818 B2 3/2013 Edwards et al.
8,398,820 B2 3/2013 Edwards et al.
8,425,721 B2 4/2013 Tynkkynen et al.
8,435,381 B2 5/2013 Murray et al.
8,461,412 B2 6/2013 Febo et al.
8,496,637 B2 7/2013 Hundorf et al.
8,512,516 B2 8/2013 Murray et al.
8,524,040 B2 9/2013 Edwards et al.
8,540,846 B2 9/2013 Miller et al.
8,545,676 B2 10/2013 Super et al.
8,552,252 B2 10/2013 Hundorf et al.
8,562,786 B2 10/2013 Murray et al.
8,568,559 B2 10/2013 Murray et al.
8,568,560 B2 10/2013 Murray et al.
8,603,296 B2 12/2013 Edwards et al.
8,632,658 B2 1/2014 Miller et al.
8,636,874 B2 1/2014 Super et al.
8,647,105 B2 2/2014 Awofeso et al.
8,652,300 B2 2/2014 Super et al.
8,662,344 B2 3/2014 Gispert
8,673,115 B2 3/2014 Edwards et al.
8,674,170 B2 3/2014 Busam et al.
8,702,668 B2 4/2014 Noel
8,741,105 B2 6/2014 Beaupre et al.
8,766,031 B2 7/2014 Becker et al.
8,778,138 B2 7/2014 Super et al.
8,791,318 B2 7/2014 Becker et al.
8,815,056 B2 8/2014 Araki et al.
8,829,263 B2 9/2014 Haggstrom et al.
8,841,506 B2 9/2014 Febo et al.
8,852,397 B2 10/2014 Super et al.
8,864,944 B2 10/2014 Miller et al.
8,864,945 B2 10/2014 Miller et al.
8,911,592 B2 12/2014 Edwards et al.
8,968,516 B2 3/2015 Super et al.
8,979,815 B2 3/2015 Roe et al.
8,980,052 B2 3/2015 Super et al.
9,017,517 B2 4/2015 Super et al.
9,044,359 B2 6/2015 Wciorka et al.
9,051,691 B2 6/2015 Miller et al.
9,057,158 B2 6/2015 Miller et al.
9,138,360 B1 9/2015 Febo et al.
9,144,524 B2 9/2015 Febo et al.
9,216,116 B2 12/2015 Roe et al.
9,216,118 B2 12/2015 Roe et al.
9,228,048 B2 1/2016 Wibaux et al.
9,241,845 B2 1/2016 Hundorf et al.
9,243,367 B2 1/2016 Rekoske et al.
9,267,240 B2 2/2016 Lee et al.
9,279,219 B2 3/2016 Edwards et al.
9,309,627 B2 4/2016 Miller et al.
9,326,896 B2 5/2016 Schäfer et al.
9,333,120 B2 5/2016 Lavon et al.
9,334,610 B2 5/2016 Kinnunen et al.
9,340,363 B2 5/2016 Jackels et al.
9,365,977 B2 6/2016 Beaupre et al.
9,371,614 B2 6/2016 Schuh et al.
9,371,615 B2 6/2016 Super et al.
9,375,358 B2 6/2016 Ehmsperger et al.
9,382,665 B2 7/2016 Miller et al.
9,388,534 B2 7/2016 Super et al.
9,447,543 B2 9/2016 Matula
9,468,566 B2 10/2016 Rosati et al.
9,476,162 B2 10/2016 Lee et al.
9,492,328 B2 11/2016 Jackels et al.
9,493,911 B2 11/2016 Miller et al.
9,532,910 B2 1/2017 Rosati et al.
9,572,728 B2 2/2017 Ashton et al.
9,579,238 B2 2/2017 Noel
9,603,755 B2 3/2017 Tanaka
9,649,232 B2 5/2017 Hippe et al.
9,649,830 B2 5/2017 Rasch
9,657,443 B2 5/2017 Rekoske et al.
9,662,246 B2 5/2017 Collinson et al.
9,668,926 B2 6/2017 Jackels et al.
9,708,774 B2 7/2017 Lee et al.
9,713,556 B2 7/2017 Arizti et al.
9,713,557 B2 7/2017 Arizti et al.
9,739,015 B2 8/2017 Miller et al.
9,744,755 B2 8/2017 Thompson, Jr. et al.
9,752,280 B2 9/2017 Matula
9,763,835 B2 9/2017 Becker et al.
9,789,009 B2 10/2017 Joseph
9,789,011 B2 10/2017 Roe et al.
9,808,554 B2 11/2017 Swaniker
9,822,487 B2 11/2017 Ahoniemi et al.
9,877,872 B2 1/2018 Mumby et al.
9,879,382 B2 1/2018 Miller et al.
9,950,309 B2 4/2018 Lee et al.
9,963,568 B2 5/2018 Nakatsuji et al.
9,974,697 B2 5/2018 Lavon et al.
9,974,699 B2 5/2018 Kreuzer et al.
9,987,176 B2 6/2018 Roe et al.
9,988,763 B2 6/2018 Ramaratnam et al.
9,994,712 B2 6/2018 Cai et al.
9,995,005 B2 6/2018 Ramaratnam et al.
10,004,647 B2 6/2018 Jackels et al.
10,022,280 B2 7/2018 Ehrnsperger et al.
10,034,800 B2 7/2018 Febo et al.
10,039,673 B2 8/2018 Mumby et al.
10,039,676 B2 8/2018 LaVon
10,052,242 B2 8/2018 Bianchi et al.
10,065,175 B2 9/2018 Lee et al.
10,071,002 B2 9/2018 Bianchi et al.
10,076,449 B2 9/2018 Allen et al.
10,099,425 B2 10/2018 Miller, IV et al.
10,130,519 B2 11/2018 Mumby et al.
10,130,525 B2 11/2018 Rosati et al.
10,130,527 B2 11/2018 Peri et al.
10,137,039 B2 11/2018 Stelzig et al.
10,138,600 B2 11/2018 Jannari et al.
10,149,788 B2 12/2018 Kreuzer et al.
10,190,263 B2 1/2019 Ramaratnam et al.
10,196,780 B2 2/2019 Lee et al.
10,201,644 B2 2/2019 Haggstrom et al.
10,208,426 B2 2/2019 Sealey et al.
10,221,350 B2 3/2019 Shalagina et al.
10,231,874 B2 3/2019 Mumby et al.
10,245,188 B2 4/2019 Jackels et al.
10,247,195 B2 4/2019 Manninen et al.
10,259,151 B2 4/2019 Kiiskinen et al.
10,273,635 B2 4/2019 Miller, IV et al.
10,292,875 B2 5/2019 Tapp et al.
10,301,775 B2 5/2019 Nordström et al.
10,301,779 B2 5/2019 Sealey et al.
10,322,040 B2 6/2019 Stiehl et al.
10,335,324 B2 7/2019 Roe et al.
10,435,826 B2 * 10/2019 Strandqvist ..... D04H 1/492
10,619,303 B2 4/2020 Thole et al.
11,015,292 B2 * 5/2021 Venema ..... D04H 1/732
11,136,700 B2 10/2021 Venema et al.
11,173,077 B2 * 11/2021 Erdem ..... B32B 7/09
11,285,056 B2 * 3/2022 Erdem ..... A61F 13/15699
11,291,595 B2 * 4/2022 Rosati ..... A61F 13/496
2001/0013389 A1 8/2001 Fingal et al.
2001/0041876 A1 * 11/2001 Creagan ..... D04H 1/4309 604/368
2002/0007169 A1 1/2002 Graef et al.

(56) References Cited

U.S. PATENT DOCUMENTS

2002/0013560 A1 1/2002 Erspamer et al.
2002/0055310 A1 5/2002 Falk et al.
2002/0088581 A1 7/2002 Graef et al.
2002/0092634 A1 7/2002 Rokman et al.
2002/0132121 A1 9/2002 Palacio et al.
2003/0106656 A1 6/2003 Johnson et al.
2003/0134094 A1* 7/2003 Zafiroglu ..... B32B 7/14 428/198
2003/0139715 A1 7/2003 Dodge et al.
2003/0167045 A1 9/2003 Graef et al.
2003/0171727 A1 9/2003 Graef et al.
2003/0193836 A1* 10/2003 Kinsley, Jr. ..... B01F 7/1675 366/307
2003/0220039 A1 11/2003 Chen et al.
2004/0045685 A1 3/2004 Horner et al.
2004/0063367 A1 4/2004 Dodge et al.
2004/0065420 A1 4/2004 Graef et al.
2004/0084162 A1 5/2004 Shannon et al.
2004/0084164 A1 5/2004 Shannon et al.
2004/0096642 A1 5/2004 Maruyama et al.
2004/0110017 A1 6/2004 Lonsky et al.
2004/0111817 A1 6/2004 Chen et al.
2004/0112783 A1 6/2004 Mukai et al.
2004/0115419 A1 6/2004 Qin et al.
2004/0115451 A1 6/2004 Lonsky et al.
2004/0121680 A1 6/2004 Yahiaoui et al.
2004/0121905 A1* 6/2004 Ranganathan ..... A61L 15/60 502/402
2004/0127873 A1 7/2004 Varona et al.
2004/0142620 A1 7/2004 Kinsley
2004/0157524 A1 8/2004 Polat et al.
2004/0254551 A1 12/2004 Carnes et al.
2004/0256066 A1 12/2004 Lindsay et al.
2005/0034826 A1 2/2005 Hu
2005/0060933 A1 3/2005 Henson
2005/0090789 A1 4/2005 Graef et al.
2005/0095980 A1 5/2005 Chang
2005/0124709 A1 6/2005 Krueger et al.
2005/0136772 A1 6/2005 Chen et al.
2005/0142348 A1 6/2005 Kajander et al.
2005/0152954 A1 7/2005 Farrell et al.
2005/0230069 A1 10/2005 Hilbig et al.
2005/0244627 A1 11/2005 Travelute et al.
2005/0247397 A1 11/2005 Kraus et al.
2005/0247416 A1 11/2005 Forry et al.
2005/0267226 A1 12/2005 Wehr et al.
2006/0005916 A1 1/2006 Stelljes et al.
2006/0011315 A1* 1/2006 Kinsley, Jr. ..... D21H 13/26 162/101
2006/0030632 A1 2/2006 Krueger et al.
2006/0081348 A1 4/2006 Graef et al.
2006/0135026 A1 6/2006 Arendt et al.
2006/0142719 A1 6/2006 Vogt et al.
2006/0191357 A1 8/2006 Minerath et al.
2006/0266485 A1 11/2006 Knox et al.
2006/0266487 A1 11/2006 Scherb et al.
2007/0048511 A1* 3/2007 Nagahara ..... D04H 1/54 428/292.1
2007/0148433 A1 6/2007 Mallory et al.
2007/0179210 A1 8/2007 Swaniker
2007/0218485 A1 9/2007 Davis et al.
2007/0269644 A1 11/2007 Harper et al.
2008/0052859 A1 3/2008 Orlandi
2008/0179775 A1 7/2008 Palm et al.
2008/0312617 A1 12/2008 Hundorf et al.
2008/0312618 A1 12/2008 Hundorf et al.
2008/0312619 A1 12/2008 Ashton et al.
2008/0312620 A1 12/2008 Ashton et al.
2008/0312621 A1 12/2008 Hundorf et al.
2008/0312622 A1 12/2008 Hundorf et al.
2008/0312625 A1 12/2008 Hundorf et al.
2008/0312628 A1 12/2008 Hundorf et al.
2009/0000753 A1 1/2009 Vestola et al.
2009/0001635 A1 1/2009 Newson et al.
2009/0008275 A1 1/2009 Ferrari et al.
2009/0077938 A1 3/2009 Kume et al.
2009/0117365 A1 5/2009 Mallory et al.
2009/0131898 A1 5/2009 Malmgren et al.
2009/0205794 A1 8/2009 Scherb et al.
2009/0270005 A1 10/2009 Takahashi et al.
2010/0075858 A1 3/2010 Davis et al.
2010/0132144 A1 6/2010 Rautray
2010/0136294 A1 6/2010 Manifold et al.
2010/0251611 A1 10/2010 Henson
2010/0273716 A1 10/2010 Harris
2010/0327484 A1 12/2010 Schuh et al.
2012/0121674 A1 5/2012 Pedoja
2014/0090217 A1* 4/2014 Jonsson ..... D04H 1/492 28/103
2014/0102650 A1 4/2014 Qin et al.
2014/0189970 A1 7/2014 Fingal et al.
2014/0231037 A1 8/2014 Beaupre et al.
2014/0259484 A1* 9/2014 Baer ..... A47L 13/17 15/104.93
2014/0324007 A1 10/2014 Hundorf et al.
2015/0144829 A1 5/2015 Grünbauer
2015/0284911 A1 10/2015 Juvonen et al.
2015/0330029 A1* 11/2015 Ramaratnam ..... B32B 3/30 15/104.93
2016/0219810 A1 8/2016 Erkkilä et al.
2016/0353820 A1 12/2016 Baychar
2017/0016149 A1* 1/2017 Nakamura ..... D21H 21/18
2017/0335521 A1 11/2017 Lee
2017/0335522 A1 11/2017 Heiskanen et al.
2017/0362775 A1 12/2017 Juvonen et al.
2018/0119353 A1 5/2018 Tolfsson et al.
2018/0140529 A1* 5/2018 Miller, IV ..... A61K 8/66
2018/0325755 A1* 11/2018 Qin ..... D21H 13/00
2018/0327973 A1 11/2018 Siitonen et al.
2018/0355527 A1 12/2018 Strandqvist et al.
2019/0161915 A1 5/2019 Swails et al.
2019/0226133 A1* 7/2019 Venema ..... B32B 5/26
2019/0240084 A1* 8/2019 Rosati ..... A61F 13/51121
2020/0190739 A1* 6/2020 Qin ..... D21H 15/10
2020/0307149 A1* 10/2020 Zhang ..... A61F 13/53
2020/0370246 A1* 11/2020 Calewarts ..... D04H 1/559
2021/0238804 A1* 8/2021 Venema ..... D21F 1/66
2021/0292948 A1* 9/2021 Nhan ..... D04H 1/76

FOREIGN PATENT DOCUMENTS

AT 519423 A3 8/2018
AU 281485 B 2/1965
AU 1973057198 A 1/1975
AU 700394 B2 1/1999
AU 721197 B2 6/2000
AU 2002300959 6/2003
AU 2001285005 B2 2/2006
AU 2007272602 A1 1/2008
AU 2012298266 B2 6/2016
BE 436451 A 9/1939
CA 949706 A 6/1974
CA 979699 A 12/1975
CA 2194176 A1 12/1996
CA 2868935 A1 9/2014
CA 2998561 A1 3/2018
CN 1173122 A 2/1998
CN 1260977 A 7/2000
CN 1270648 A 10/2000
CN 1364182 A 8/2002
CN 1094542 C 11/2002
CN 1518423 A 8/2004
CN 101410078 B 2/2014
CN 103993498 B 3/2016
CN 105828763 A 8/2016
CN 105828764 A 8/2016
CN 105899173 A 8/2016
CN 104302834 B 11/2016
CN 106456416 A 2/2017
CN 107460764 A 12/2017
CN 107988838 A 5/2018
CN 109937027 A 6/2019
DE 2041406 A1 4/1971

(56) References Cited

FOREIGN PATENT DOCUMENTS

| | | | | | |
|---|---|---|---|---|---|
| DE | 2438587 | A1 | | 3/1975 | |
| DE | 2902255 | A1 | | 7/1980 | |
| DE | 3307736 | A1 | | 9/1984 | |
| DE | 3420195 | C2 | | 6/1987 | |
| DE | 4207233 | A1 | | 11/1993 | |
| EP | 0101319 | A3 | | 3/1984 | |
| EP | 0049944 | B1 | | 11/1984 | |
| EP | 0136329 | A4 | | 1/1989 | |
| EP | 0158938 | B1 | | 12/1989 | |
| EP | 0296242 | A4 | | 7/1991 | |
| EP | 0443082 | A1 | | 8/1991 | |
| EP | 0242361 | B1 | | 9/1991 | |
| EP | 0512819 | A1 | | 11/1992 | |
| EP | 0150777 | B2 | | 11/1994 | |
| EP | 0481745 | B1 | | 7/1996 | |
| EP | 0537005 | B1 | | 7/1997 | |
| EP | 0671504 | B1 | | 8/1997 | |
| EP | 0742858 | B1 | | 6/1999 | |
| EP | 1007784 | B1 | | 2/2003 | |
| EP | 1145695 | A3 | | 1/2004 | |
| EP | 1194644 | B1 | | 3/2004 | |
| EP | 1400224 | B1 | | 3/2006 | |
| EP | 1384457 | B1 | | 5/2006 | |
| EP | 1808116 | A1 | | 7/2007 | |
| EP | 1649094 | B1 | | 9/2007 | |
| EP | 1442173 | B1 | | 3/2008 | |
| EP | 1583865 | B1 | | 5/2008 | |
| EP | 1463432 | B1 | | 8/2008 | |
| EP | 1576233 | B1 | | 10/2008 | |
| EP | 1813237 | A3 | | 12/2008 | |
| EP | 1932968 | B1 | | 9/2009 | |
| EP | 1967626 | A4 | | 9/2009 | |
| EP | 1666240 | B1 | | 3/2011 | |
| EP | 1440195 | B1 | | 8/2011 | |
| EP | 1812637 | B1 | | 1/2012 | |
| EP | 1950343 | B1 | | 4/2012 | |
| EP | 1456472 | B2 | | 5/2012 | |
| EP | 1497489 | B1 | | 8/2012 | |
| EP | 1808152 | B1 | | 8/2012 | |
| EP | 1567718 | B1 | | 4/2013 | |
| EP | 2599915 | A1 | | 6/2013 | |
| EP | 1268937 | B1 | | 2/2014 | |
| EP | 2540892 | B1 | | 4/2014 | |
| EP | 1876291 | B1 | | 9/2014 | |
| EP | 2843130 | A1 | | 3/2015 | |
| EP | 2952164 | A1 | | 12/2015 | |
| EP | 2952165 | A1 | | 12/2015 | |
| EP | 2737131 | B1 | | 1/2016 | |
| EP | 1916333 | B1 | | 6/2016 | |
| EP | 2001662 | B1 | | 6/2016 | |
| EP | 1380401 | B1 | | 7/2016 | |
| EP | 2807212 | B1 | | 4/2017 | |
| EP | 2940210 | B1 | | 8/2017 | |
| EP | 2622132 | B1 | | 4/2018 | |
| EP | 3327395 | A1 | | 5/2018 | |
| EP | 3162956 | B1 | | 3/2019 | |
| EP | 3108060 | B1 | | 4/2021 | |
| ES | 385106 | A1 | | 3/1973 | |
| ES | 8606100 | A1 | | 4/1986 | |
| ES | 2362723 | T3 | | 7/2011 | |
| FI | 812601 | A | | 2/1982 | |
| FI | 843904 | A | | 10/1984 | |
| FI | 83741 | C | | 12/1992 | |
| FI | 112812 | B | | 1/2004 | |
| FI | 127377 | B | | 4/2018 | |
| FI | 128917 | B | | 3/2021 | |
| FR | 873763 | A | | 7/1942 | |
| FR | 1449737 | A | | 8/1966 | |
| FR | 1528992 | A | | 6/1968 | |
| FR | 2206398 | B3 | | 9/1976 | |
| GB | 848756 | A | * | 9/1960 | |
| GB | 1145484 | A | | 3/1969 | |
| GB | 2109023 | A | | 5/1983 | |
| GB | 2136813 | A | | 9/1984 | |
| GB | 2116882 | B | | 10/1985 | |
| GB | 2576998 | A | * | 3/2020 | ..... D21H 21/56 |
| IN | 1182DEL2005 | A | | 1/2007 | |
| IN | 231170 | B | | 3/2009 | |
| IN | 2957KOLNP2014 | A | | 5/2015 | |
| IN | 3108MUM2014 | A | | 4/2016 | |
| IN | 283291 | B | | 5/2017 | |
| IN | 201717030330 | A | | 12/2017 | |
| IN | 201837033267 | A | | 10/2018 | |
| JP | 1983115199 | A | | 7/1983 | |
| JP | 1989501859 | A | | 6/1989 | |
| JP | 1993140886 | A | | 6/1993 | |
| JP | 11302991 | A2 | | 11/1999 | |
| JP | 2003147670 | A | | 5/2003 | |
| KR | 1020040088545 | A | | 10/2004 | |
| KR | 100450272 | B1 | | 12/2005 | |
| KR | 100637646 | B1 | | 10/2006 | |
| KR | 100685522 | B1 | | 2/2007 | |
| KR | 100725240 | B1 | | 6/2007 | |
| KR | 1020100112299 | A | | 10/2010 | |
| KR | 1020130077856 | A | | 7/2013 | |
| KR | 101386319 | B1 | | 4/2014 | |
| KR | 1020180007337 | A | | 1/2018 | |
| RU | 2393093 | C2 | | 6/2010 | |
| SE | 7304825 | L | | 11/1977 | |
| SE | 7304888 | L | | 11/1977 | |
| SE | 412881 | B | | 3/1980 | |
| SE | 1651412 | A1 | | 4/2018 | |
| SE | 540719 | C2 | | 10/2018 | |
| WO | 1986003505 | A1 | | 6/1986 | |
| WO | 1991010416 | A1 | | 7/1991 | |
| WO | 1992003283 | A1 | | 3/1992 | |
| WO | 1996031652 | A1 | | 10/1996 | |
| WO | 9824621 | A1 | | 6/1998 | |
| WO | 2000001882 | A1 | | 1/2000 | |
| WO | 2000050694 | A1 | | 8/2000 | |
| WO | 2001068793 | A1 | | 9/2001 | |
| WO | 2001083866 | A2 | | 11/2001 | |
| WO | 2002055788 | A2 | | 7/2002 | |
| WO | 2003069038 | A1 | | 8/2003 | |
| WO | 2004025009 | A2 | | 3/2004 | |
| WO | 2004112956 | A1 | | 12/2004 | |
| WO | 2005060712 | A2 | | 7/2005 | |
| WO | 2006052967 | A2 | | 5/2006 | |
| WO | 2006094077 | A2 | | 9/2006 | |
| WO | 2007074625 | A1 | | 7/2007 | |
| WO | 2009006371 | A2 | | 1/2009 | |
| WO | 2009060118 | A2 | | 5/2009 | |
| WO | 2011104427 | A1 | | 9/2011 | |
| WO | 2014068196 | A2 | | 5/2014 | |
| WO | 2014080084 | A1 | | 5/2014 | |
| WO | 2014205048 | A1 | | 12/2014 | |
| WO | 2015083092 | A1 | | 6/2015 | |
| WO | 2015112155 | A1 | | 7/2015 | |
| WO | 2015173474 | A1 | | 11/2015 | |
| WO | 2016050901 | A1 | | 4/2016 | |
| WO | 2016051350 | A1 | | 4/2016 | |
| WO | 2016185398 | A1 | | 11/2016 | |
| WO | 2016200299 | A1 | | 12/2016 | |
| WO | 2017006216 | A1 | | 1/2017 | |
| WO | 2017006241 | A1 | | 1/2017 | |
| WO | 2017046751 | A1 | | 3/2017 | |
| WO | 2017079169 | A1 | | 5/2017 | |
| WO | 2017137879 | A1 | | 8/2017 | |
| WO | 2018002815 | A1 | | 1/2018 | |
| WO | 2018011667 | A1 | | 1/2018 | |
| WO | 2018041355 | A1 | | 3/2018 | |
| WO | 2018065668 | A1 | | 4/2018 | |
| WO | 2018116223 | A1 | | 6/2018 | |
| WO | 2018152082 | A1 | | 8/2018 | |
| WO | 2018171913 | A1 | | 9/2018 | |
| WO | 2018171914 | A1 | | 9/2018 | |
| WO | WO-2018199975 | A1 | * | 11/2018 | ..... D21F 11/002 |
| WO | WO-2019108172 | A1 | * | 6/2019 | ..... D21H 13/24 |

* cited by examiner

FOAM-FORMED FIBROUS SHEETS WITH CRIMPED STAPLE FIBERS

BACKGROUND

Many tissue products, such as facial tissue, bath tissue, paper towels, industrial wipers, and the like, are produced according to a wet laid process. Wet laid webs are made by depositing an aqueous suspension of pulp fibers onto a forming fabric and then removing water from the newly-formed web. Water is typically removed from the web by mechanically pressing water out of the web that is referred to as "wet-pressing." Although wet-pressing is an effective dewatering process, during the process the tissue web is compressed causing a marked reduction in the caliper of the web and in the bulk of the web.

For most applications, however, it is desirable to provide the final product with as much bulk as possible without compromising other product attributes. Thus, those skilled in the art have devised various processes and techniques in order to increase the bulk of wet laid webs. For example, creping is often used to disrupt paper bonds and increase the bulk of tissue webs. During a creping process, a tissue web is adhered to a heated cylinder and then creped from the cylinder using a creping blade.

Another process used to increase web bulk is known as "rush transfer." During a rush transfer process, a web is transferred from a first moving fabric to a second moving fabric in which the second fabric is moving at a slower speed than the first fabric. Rush transfer processes increase the bulk, caliper, and softness of the tissue web.

As an alternative to wet-pressing processes, through-drying processes have developed in which web compression is avoided as much as possible to preserve and enhance the bulk of the web. These processes provide for supporting the web on a coarse mesh fabric while heated air is passed through the web to remove moisture and dry the web.

Additional improvements in the art, however, are still needed. In particular, a need currently exists for an improved process that includes unique fibers in a tissue web for increasing the bulk and softness of the web without having to subject the web to a rush transfer process or to a creping process.

SUMMARY

In general, the present disclosure is directed to further improvements in the art of tissue and papermaking. Through the processes and methods of the present disclosure, the properties of a tissue web, such as bulk, stretch, caliper, and/or absorbency can be improved. In particular, the present disclosure is directed to a process for forming a nonwoven web, particularly a tissue web containing pulp fibers, in a foam-forming process. For example, a foam suspension of fibers can be formed and spread onto a moving porous conveyor for producing an embryonic web.

In one aspect, for instance, the present disclosure is directed to a method for producing a high-bulk, foam-formed substrate includes producing an aqueous-based foam including at least 1% by weight crimped synthetic fibers and at least 1% by weight binder fibers; forming a wet sheet from the aqueous-based foam; and drying the wet sheet to obtain the foam-formed substrate.

In another aspect, a substrate includes an aqueous-based polymer foam including at least 1% by weight crimped synthetic fiber and at least 1% by weight binder fiber, wherein the substrate is free of superabsorbent material.

In yet another aspect, a method for producing a high-bulk, foam-formed substrate includes producing an aqueous-based foam including at least 2% by weight crimped binder fibers; forming a wet sheet from the aqueous-based foam; and drying the wet sheet to obtain the foam-formed substrate, wherein the foam-formed substrate is free of superabsorbent material, and wherein the substrate has a dry density between 0.02 g/cc and 0.1 g/cc.

Other features and aspects of the present disclosure are discussed in greater detail below.

BRIEF DESCRIPTION OF THE DRAWINGS

The foregoing and other features and aspects of the present disclosure and the manner of attaining them will become more apparent, and the disclosure itself will be better understood by reference to the following description, appended claims and accompanying drawings, where:

Figure 1:
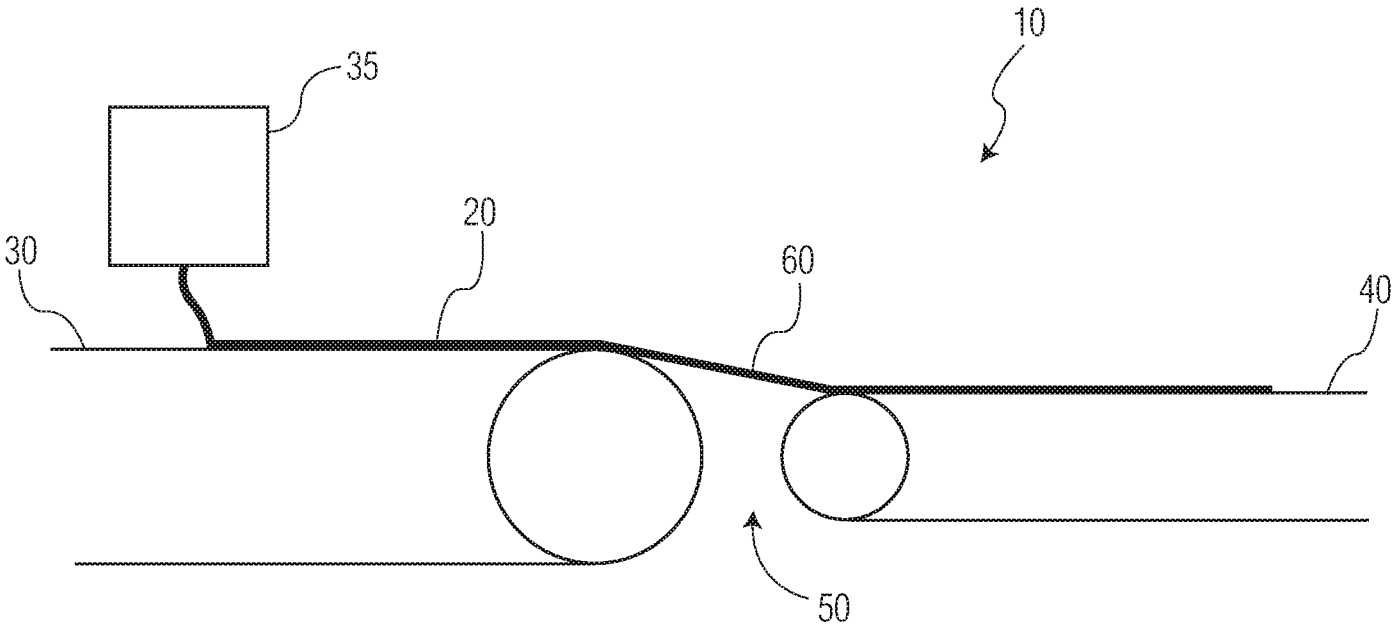
FIG. 1 is a schematic illustration of a foam-formed wet sheet being transferred from a forming wire onto a drying wire on a pilot line.

Repeat use of reference characters in the present specification and drawings is intended to represent the same or analogous features or elements of the present disclosure. The drawings are representational and are not necessarily drawn to scale. Certain proportions thereof might be exaggerated, while others might be minimized.

DETAILED DESCRIPTION

It is to be understood by one of ordinary skill in the art that the present discussion is a description of exemplary aspects of the present disclosure only, and is not intended as limiting the broader aspects of the present disclosure.

In general, the present disclosure is directed to the formation of tissue or paper webs having good bulk and softness properties. Through the process of the present disclosure, tissue webs can be formed, for instance, having better stretch properties, improved absorbency characteristics, increased caliper, and/or increased softness. In one aspect, patterned webs can also be formed. In one aspect, for instance, a tissue web is made according to the present disclosure from a foamed suspension of fibers.

There are many advantages and benefits to a foam-forming process as described above. During a foam-forming process, water is replaced with foam as the carrier for the fibers that form the web. The foam, which represents a large quantity of air, is blended with papermaking fibers. Because less water is used to form the web, less energy is required to dry the web. For instance, drying the web in a foam-forming process can reduce energy requirements by greater than about 10%, or such as greater than about 20%, in relation to conventional wet pressing processes.

Foam-forming technology has proven its capabilities in bringing many benefits to products including improved fiber uniformity, reduced water amount in the process, reduced drying energy due to both reduced water amount and surface tension, improved capability of handling an extremely long or short fiber that enables an introduction of long staple fiber and very short fiber fine into a regular wet laying process, and enhanced bulk/reduced density that broadens one process to be able to produce various materials from a high to a very low density to cover multiple product applications.

Bench experimentation using a high speed mixer and surfactant has produced a very low density, between 0.008 to 0.02 g/cc, foam-formed fibrous materials. Based on these results, an air-formed, 3D-structured, nonwoven-like fibrous material can be produced using a low cost but high speed wet laying process. Previous attempts to produce such low density fibrous materials using typical foam-forming lines did not produce favorable results. Both processes have equipment limitations preventing production of a low density or high bulk foam-formed fibrous material. One process lacks a drying capability and therefore must use a press with high pressure to remove water from a formed wet sheet as much as possible to gain wet sheet integrity, so the sheet can be winded onto a roll. In addition, another process does not have a pressure roll but has a continuous drying tunnel. While the latter process appears to have a potential to produce a low density fibrous material, the foam-formed wet sheet must be transferred from a forming fabric to a drying metal wire before it is dried inside the drying tunnel. Again, to gain enough wet sheet integrity for this transfer, the foam-formed sheet must be dewatered as much as possible by vacuum prior to this transfer. As a result, most of entrapped air bubbles inside the wet sheet are also removed by the vacuum, resulting in a final dried sheet with a density similar to that of a sheet produced by a normal wet laying process.

The latter process includes a foam-forming line that is designed to handle long staple fiber and is capable of achieving very uniform fiber mixing with other components. It is not, however, designed for producing high bulk fibrous material due to its equipment limitations as discussed above. FIG. 1 illustrates the difficulty in using this process to produce high bulk fibrous material, where a sheet is transferred between two wires. In this pilot line, a frothed fibrous material 20 is formed onto a forming wire 30 by a headbox 35, where the material 20 has a high bulk when it is just laid onto the forming wire 30. The material 20 is then subjected to a high vacuum to remove as much of water as possible so that when the wet sheet 20 travels to the end of the first forming wire 30, it gains enough integrity or strength to allow the sheet 20 to be shifted to a drying wire 40. There is an air gap 50 between the forming and drying wires 30, 40 where the sheet 20 forms a bridge 60 between the forming and drying wires 30, 40. Reducing the vacuum level to keep a certain amount of water in the wet sheet 20 can allow the sheet to retain a sufficient amount of frothed air bubbles to enhance its bulk. In this method, however, the wet sheet 20 formed did not have sufficient strength to form the bridge 60 at the location shown in FIG. 1. As a result, a modified process or a new fibrous composition is needed to produce an open structure, high bulk material even with the removal of as much water as possible.

Figure 2A:
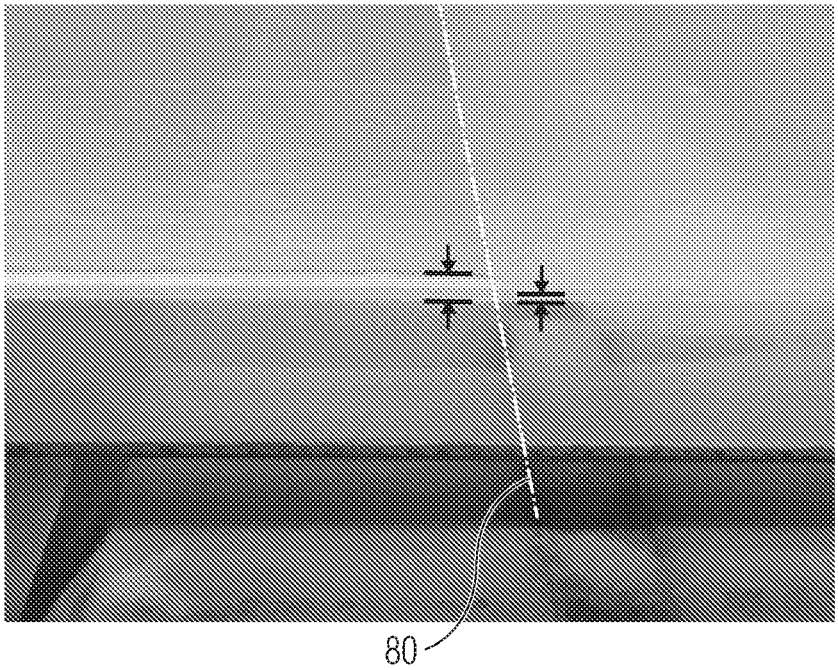
FIG. 2A is a photographic illustration of a foam-formed wet fibrous sheet without crimped fiber.
Figure 2B:
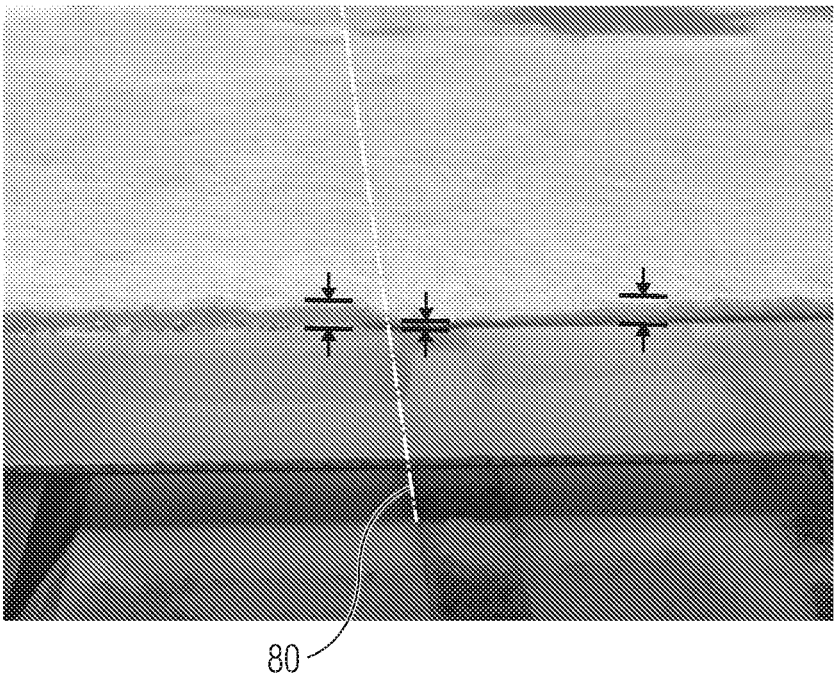
FIG. 2B is a photographic illustration of a foam-formed wet fibrous sheet with crimped fiber.
Figure 3A:
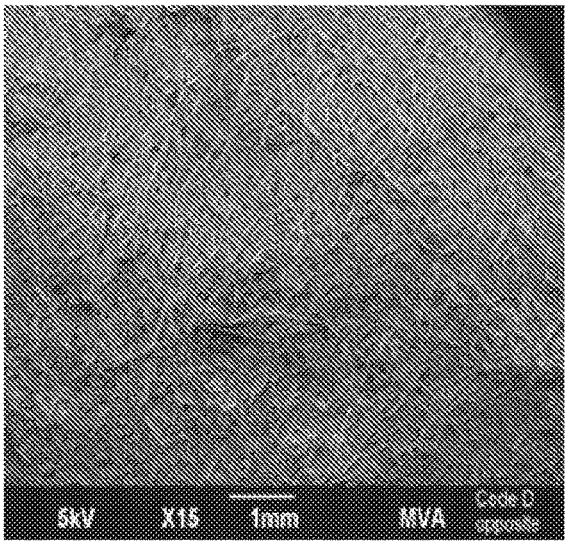
FIG. 3A is a surface scanning electron microscope (SEM) photographic illustration pictures of Codes C at a magnification level of 15×.
Figure 3B:
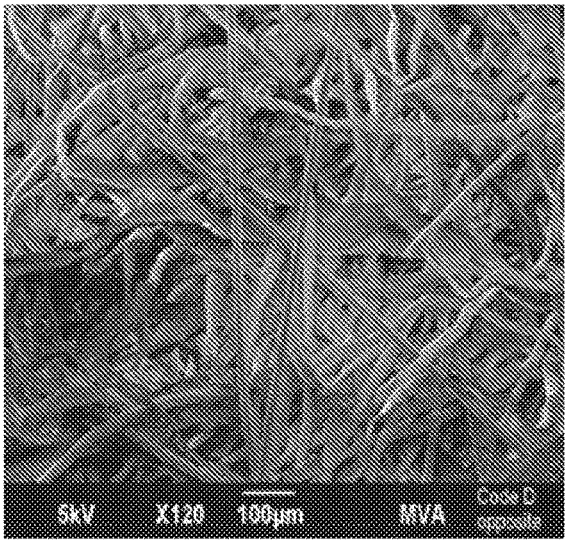
FIG. 3B is a surface SEM photographic illustration of Code C at a magnification level of 120×.
Figure 3C:
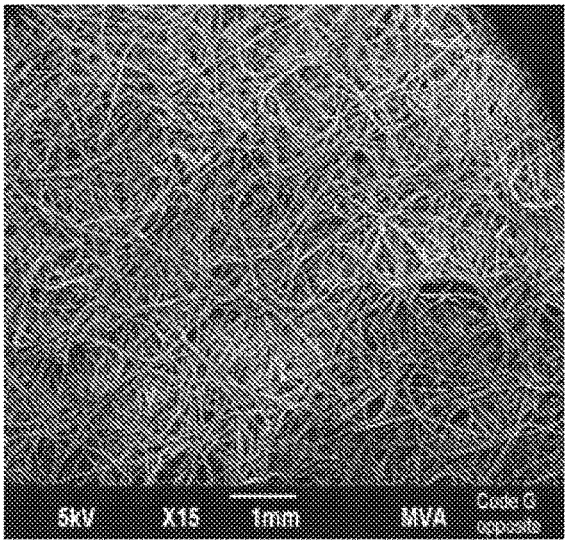
FIG. 3C is a surface SEM photographic illustration of Code D at a magnification level of 15×.
Figure 3D:
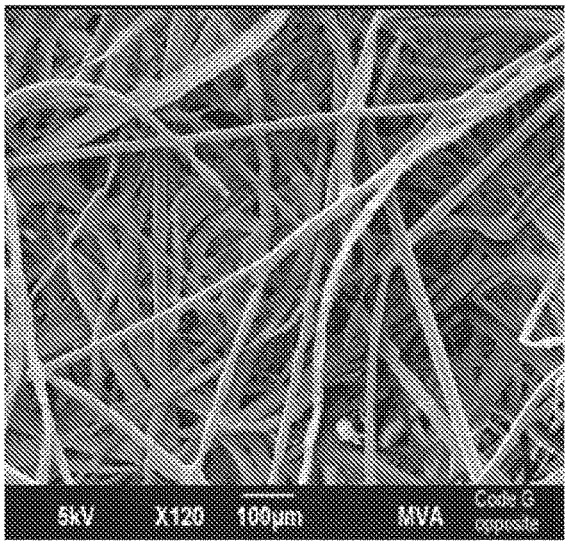
FIG. 3D is a surface SEM photographic illustration of Code D at a magnification level of 120×.
Figure 3E:
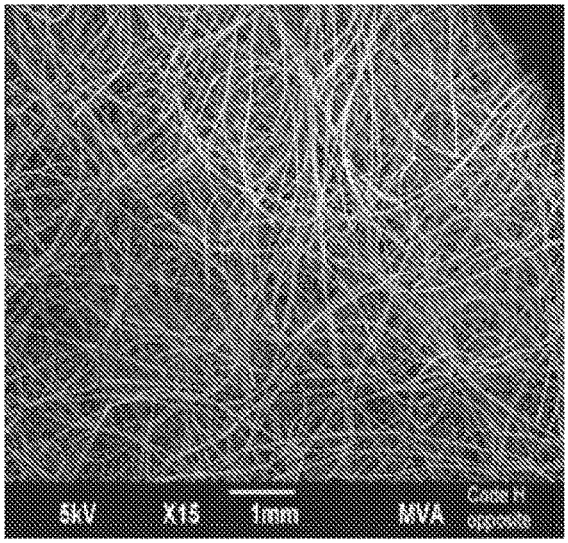
FIG. 3E is a surface SEM photographic illustration of Code E at a magnification level of 15×.
Figure 3F:
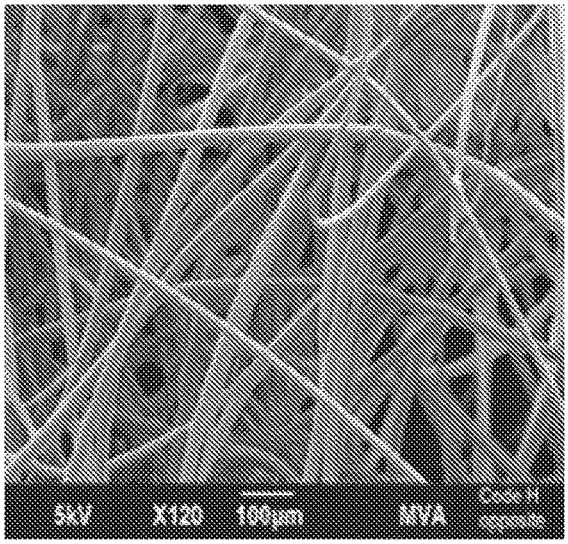
FIG. 3F is a surface SEM photographic illustration of Code E at a magnification level of 120×.
Figure 4A:
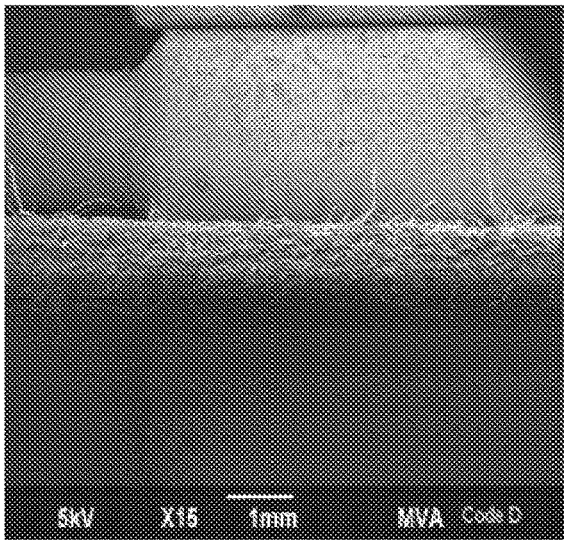
FIG. 4A is a cross-sectional SEM photographic illustration of Code C at a magnification level of 15×.
Figure 4B:
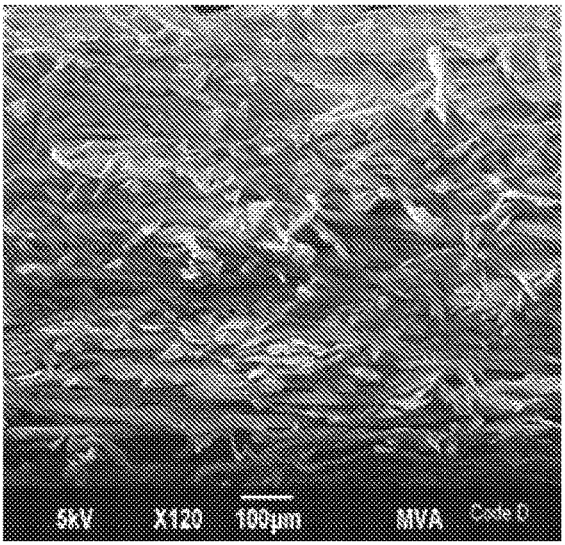
FIG. 4B is a cross-sectional SEM photographic illustration of Code C at a magnification level of 120×.
Figure 4C:
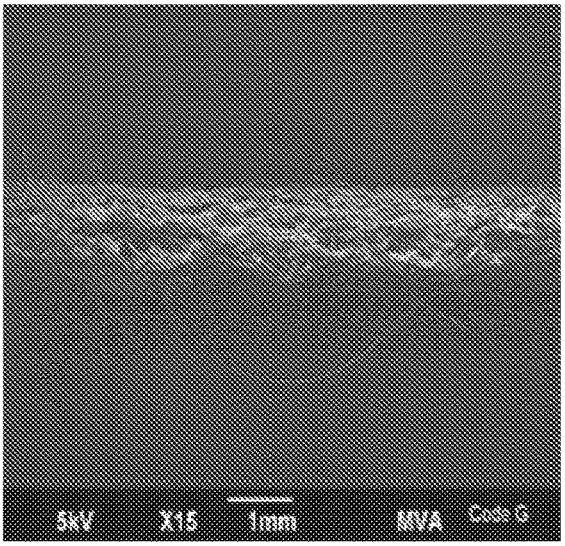
FIG. 4C is a cross-sectional SEM photographic illustration of Code D at a magnification level of 15×.
Figure 4D:
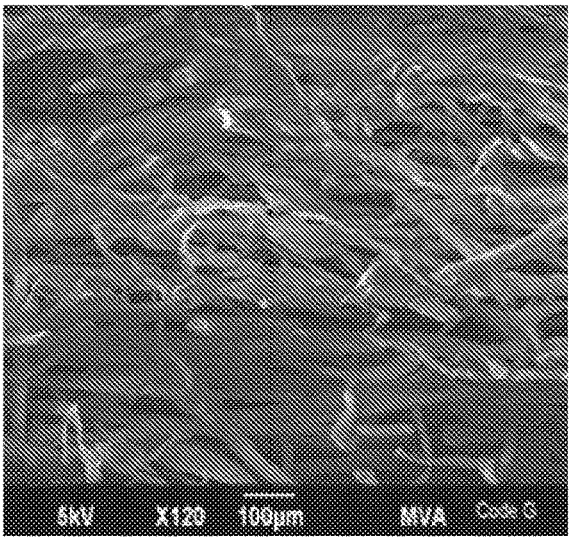
FIG. 4D is a cross-sectional SEM photographic illustration of Code D at a magnification level of 120×.
Figure 4E:
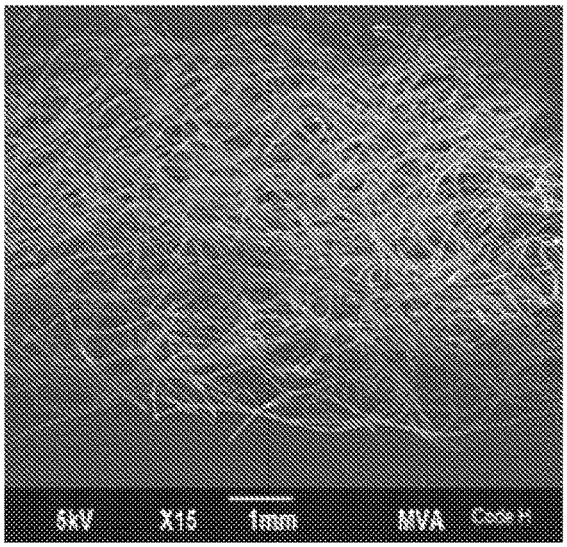
FIG. 4E is a cross-sectional SEM photographic illustration of Code E at a magnification level of 15×.
Figure 4F:
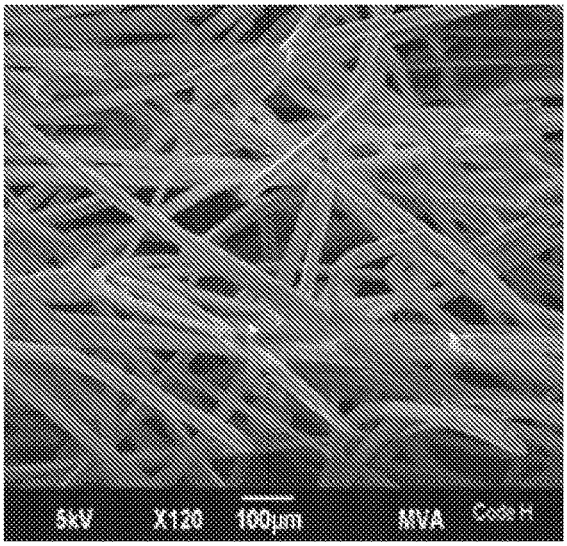
FIG. 4F is a cross-sectional SEM photographic illustration of Code E at a magnification level of 120×.

Further experimentation resulted in the discovery that an addition of as little as 20% crimped staple fiber reduces the final fibrous sheet density as much as nearly 50%. FIG. 2 demonstrates such an improvement in maintaining wet sheet thickness. FIG. 2A shows total wet sheet bulk without crimped fiber collapsing along a dewatering vacuum line 80, while FIG. 2B shows only a slightly reduction in sheet thickness, due to presence of a crimped fiber.

Without committing to a theory, it is believed that the crimped fiber that acts as many rigid springs inside the foam-formed wet fibrous sheet to keep the fibrous structure open even after a complete removal of both water and entrapped air bubbles. Because of this, the crimped fiber length, diameter, crimped structure (i.e., 2D vs. 3D crimped shapes), polymer type, and crimped fiber amount are all factors affecting density or bulk of a foam-formed fibrous material.

According to the present disclosure, the foam-forming process is combined with a unique fiber addition for producing webs having a desired balance of properties.

In forming tissue or paper webs in accordance with the present disclosure, in one aspect, a foam is first formed by combining water with a foaming agent. The foaming agent, for instance, can include any suitable surfactant. In one aspect, for instance, the foaming agent can include an anionic surfactant such as sodium lauryl sulfate, which is also known as sodium laureth sulfate and sodium lauryl ether sulfate. Other anionic foaming agents include sodium dodecyl sulfate or ammonium lauryl sulfate. In other aspects, the foaming agent can include any suitable cationic, non-ionic, and/or amphoteric surfactant. For instance, other foaming agents include fatty acid amines, amides, amine oxides, fatty acid quaternary compounds, polyvinyl alcohol, polyethylene glycol alkyl ether, polyoxyethylene soritan alkyl esters, glucoside alkyl ethers, cocamidopropyl hydroxysultaine, cocamidopropyl betaine, phosphatidylethanolamine, and the like.

The foaming agent is combined with water generally in an amount greater than about 0.001% by weight, such as in an amount greater than about 0.005% by weight, such as in an amount greater than about 0.01% by weight, or such as in an amount greater than about 0.05% by weight. The foaming agent can also be combined with water generally in an amount less than about 0.2% by weight, such as in an amount less than about 0.5% by weight, such as in an amount less than about 1.0% by weight, or such as in an amount less than about 5% by weight. One or more foaming agents are generally present in an amount less than about 5% by weight, such as in an amount less than about 2% by weight, such as in an amount less than about 1% by weight, or such as in an amount less than about 0.5% by weight.

Once the foaming agent and water are combined, the mixture is combined with a fiber furnish. In general, any fibers capable of making a tissue or paper web or other similar type of nonwoven in accordance with the present disclosure can be used.

Fibers suitable for making tissue webs include any natural and/or synthetic fibers. Natural fibers can include, but are not limited to, nonwoody fibers such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; and hardwood fibers, such as eucalyptus, maple, birch, and aspen. Pulp fibers can be prepared in high-yield or low-yield forms and can be pulped in any known method, including kraft, sulfite, high-yield pulping methods, and other known pulping methods. Fibers prepared from organosolv pulping methods can also be used.

A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is FYBREL polyethylene fibers available from Minifibers, Inc. (Jackson City, Tenn.). Any known bleaching method can be used. Regenerated or modified cellulose fiber types include rayon in all its varieties and other fibers derived from viscose or chemically-modified cellulose. Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain aspects capable of high bulk and good compressive properties, the fibers can have a Canadian Standard Freeness of at least 200, more specifically at least 300, more specifically still at least 400, and most specifically at least 500. Binder fibers can include polyvinyl alcohol (PVA) fibers or any other suitable binder fibers.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PIMP), thermomechanical pulp (TMP), thermomechanical chemical pulp (TMCP), high yield sulfite pulps, and high yield kraft pulps, all of which leave the resulting fibers with high levels of lignin. High yield fibers are well known for their stiffness in both dry and wet states relative to typical chemically pulped fibers.

Once the foaming agent, water, and fibers are combined, the mixture is blended or otherwise subjected to forces capable of forming a foam. A foam generally refers to a porous matrix, which is an aggregate of hollow cells or bubbles that can be interconnected to form channels or capillaries.

The foam density can vary depending upon the particular application and various factors including the fiber furnish used. In one aspect, for instance, the foam density of the foam can be greater than about 200 g/L, such as greater than about 250 g/L, or such as greater than about 300 g/L. The foam density is generally less than about 600 g/L, such as less than about 500 g/L, such as less than about 400 g/L, or such as less than about 350 g/L. In one aspect, for instance, a lower density foam is used having a foam density of generally less than about 350 g/L, such as less than about 340 g/L, or such as less than about 330 g/L. The foam will generally have an air content of greater than about 40%, such as greater than about 50%, or such as greater than about 60%. The air content is generally less than about 80% by volume, such as less than about 75% by volume, or such as less than about 70% by volume.

The tissue web can also be formed without a substantial amount of inner fiber-to-fiber bond strength. In this regard, the fiber furnish used to form the base web can be treated with a chemical debonding agent. The debonding agent can be added to the foamed fiber slurry during the pulping process or can be added directly to the headbox. Suitable debonding agents that can be used in the present disclosure include cationic debonding agents such as fatty dialkyl quaternary amine salts, mono fatty alkyl tertiary amine salts, primary amine salts, imidazoline quaternary salts, silicone quaternary salt, and unsaturated fatty alkyl amine salts. Other suitable debonding agents are disclosed in U.S. Pat. No. 5,529,665 to Kaun, which is incorporated herein by reference. In particular, Kaun discloses the use of cationic silicone compositions as debonding agents.

In one aspect, the debonding agent used in the process of the present disclosure is an organic quaternary ammonium chloride and, particularly, a silicone-based amine salt of a quaternary ammonium chloride. For example, the debonding agent can be PROSOFT TQ1003 debonding agent, marketed by the Hercules Corporation. The debonding agent can be added to the fiber slurry in an amount of from about 1 kg per metric tonne to about 10 kg per metric tonne of fibers present within the slurry.

In an alternative aspect, the debonding agent can be an imidazoline-based agent. The imidazoline-based debonding agent can be obtained, for instance, from the Witco Corporation. The imidazoline-based debonding agent can be added in an amount of between 2.0 to about 15 kg per metric tonne.

Other optional chemical additives can also be added to the aqueous papermaking furnish or to the formed embryonic web to impart additional benefits to the product and process. The following materials are included as examples of additional chemicals that can be applied to the web. The chemicals are included as examples and are not intended to limit the scope of the disclosure. Such chemicals can be added at any point in the papermaking process.

Additional types of chemicals that can be added to the paper web include, but are not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin E, silicone, lotions in general, and the like can also be incorporated into the finished products.

In general, the products of the present disclosure can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles can also be employed. Additional options include cationic dyes, optical brighteners, humectants, emollients, and the like.

To form the tissue web, the foam is combined with a selected fiber furnish in conjunction with any auxiliary agents. The foam can be formed by any suitable method, including that described in co-pending U.S. Provisional Patent Application Ser. No. 62/437,974.

In general, any process capable of forming a paper web can also be utilized in the present disclosure. For example, a papermaking process of the present disclosure can utilize creping, double creping, embossing, air pressing, creped through-air drying, uncreped through-air drying, coform, hydroentangling, as well as other steps known in the art.

The basis weight of tissue webs made in accordance with the present disclosure can vary depending upon the final product. For example, the process can be used to produce bath tissues, facial tissues, paper towels, industrial wipers, and the like. In general, the basis weight of the tissue products can vary from about 6 gsm to about 120 gsm, or such as from about 10 gsm to about 90 gsm. For bath tissue and facial tissues, for instance, the basis weight can range from about 10 gsm to about 40 gsm. For paper towels, on the other hand, the basis weight can range from about 25 gsm to about 80 gsm.

The tissue web bulk can also vary from about 3 cc/g to 20 cc/g, or such as from about 5 cc/g to 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oregon. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

In multiple ply products, the basis weight of each tissue web present in the product can also vary. In general, the total basis weight of a multiple ply product will generally be the same as indicated above, such as from about 15 gsm to about 120 gsm. Thus, the basis weight of each ply can be from about 10 gsm to about 60 gsm, or such as from about 20 gsm to about 40 gsm.

A binder fiber can be used to stabilize the foam formed fibrous structure of this invention. A binder fiber can either a thermoplastic bicomponent fiber, such as PE/PET core/sheath fiber, or a water sensitive polymer fiber, such as polyvinyl alcohol fiber. Commercial binder fiber is usually a bicomponent thermoplastic fiber with two different melting polymers. Two polymers used in this bicomponent fiber usually have quite different melting points. For example, a PE/PET bicomponent fiber has a melting point of 120° C. for PE and a melting point of 260° C. for PET. When this bicomponent fiber is use as a binder fiber, a foam-formed fibrous structure including the PE/PET fiber can be stabilized by exposure to a heat treatment at a temperature slightly above 120° C. so that the PE fiber portion will melt and form inter-fiber bonds with other fibers while the PET fiber portion deliver its mechanical strength to maintain the fiber network intact. The bicomponent fiber can have different shapes with its two polymer components, such as, side-side, core-sheath, eccentric core-sheath, islands in a sea, etc. The core-sheath structure is the most commonly used in commercial binder fiber applications. Commercial binder fibers include T 255 binder fiber with a 6 or 12 mm fiber length and a 2.2 dtex fiber diameter from Trevia or WL Adhesion C binder fiber with a 4 mm fiber length and a 1.7 dtex fiber diameter from FiberVisions.

A fiber can be mechanically treated to obtain a crimped structure. A crimped fiber exhibits waviness in which the axis of a fiber under minimum external stress departs from a straight line and follows a simple, complex, or irregular wavy path. In its simplest form a crimp is uniplanar and regular, i.e., it resembles a sine wave, but it is frequently much more complicated and irregular. An example of a three-dimensional crimp is a helical crimp. The crimp can be expressed numerically as the number of waves (crimps) per unit length, or as the difference between the distances between two points on the fiber when it is relaxed and when it is straightened under suitable tension, expressed as a percentage of the relaxed distance. One attribute of a crimped fiber that is important to achieve the high bulk of the foam-formed fibrous material of this disclosure is type of polymer from which the fiber is made. For example, a polymer should have a Tg equal to or higher than 0° C. When a crimped fiber is made of a polymer such as polyethylene (PE), which has a Tg of −125° C., the fiber is soft even at a room temperature and lacks of enough modulus to keep fibrous structure open under a high external pressure even if it has the right crimped structure. Another attribute of a crimped fiber is fiber diameter. When a crimped fiber is too thin, even if it is made of a polymer having a Tg higher than 0° C., it may still lack the expansion force needed to keep the structure open. A crimped fiber should have at least 4 dtex in its fiber diameter to contribute to the high bulk enhancement disclosed herein. Suitable crimped fibers include but are not limited to PET or polyester crimped fibers manufactured by Barnet or Mini-Fiber, Inc. having a fiber length about 6 mm and a fiber diameter about 7 dtex, a PTT/PET FIT curled and bowtie shaped fiber from Fiber Innovation Technology having a fiber length about 12 mm and a fiber diameter about 6.5 dtex, and a Nylon crimped fiber from Mini-Fiber, Inc. having a fiber length about 6 mm and a fiber diameter about 13 dtex.

EXAMPLES

Different sets of experiments were conducted to confirm if a crimped staple fiber always contributes to a bulk enhancement or a density reduction for a foam-formed fibrous material. In the first set, a fiber was incorporated into a mixture of wood pulp fiber and a bi-component binder fiber using a bench high speed mixer to generate a very stable foam. This foam-formed fibrous material was cast/dried. Two materials were produced: one with 60% LL 19 wood pulp fiber, 30% PET 6 mm staple fiber without a crimped structure, and 10% Trevira's T 255 bi-component binder fiber (Code A in Table 1); the other with 60% LL 19, 30% PET 5 mm crimped fiber from MiniFiber Inc., and 10% Trevira's T 255 bi-component binder fiber (Code B in Table 1). Both of these two fibrous compositions produced very high bulk sheets with a density below 0.02 g/cc (refer to Codes A and B in Table 1).

The frothed foam produced on the bench had a low density because the foam was much more stable and also did not have water removed by a vacuum process. At such a low density, no further reduction in density was demonstrated using a crimped fiber.

The second set produced three codes for comparison. The first of these codes was a control with 60% LL 19, 20% PET 20 mm staple fiber, and 20% T 255 bi-component binder fiber (Code C). The other two codes were produced using crimped fibers. Code D had a 6.3 mm PET crimped fiber from Barnet at 20% crimped fiber, 60% LL 19, and 20% T 255 bi-component binder fiber. Code E had a 6.3 mm PET crimped fiber from Barnet at 80% crimped fiber to replace both 60% LL 19 and 20% PET non-crimped staple fiber in Code C. In both cases using a crimped fiber, a large reduction in density, meaning a large enhancement in bulk, was observed. In comparison to control Code C, Code D had a density reduction almost 50%, even though only 20% of the crimped fiber was used. Adding more crimped fiber could further reduce the density of the sheet, but degree of the reduction was largely reduced. In the Code E use of 80% crimped fiber, the density reduction was about 67% compared to the control Code C. A foam-formed material's density can be reduced when its control material has a density at least above 0.05 g/cc, or preferably at least above 0.08 g/cc. When a control foam-formed fibrous material has a density below 0.02 g/cc, the addition of crimped fiber into the foam-formed fibrous material does not further reduce the density or enhance the bulk of the foam-formed fibrous material.

FIGS. 3A-3F illustrate a series of surface SEM pictures for Codes C, D, and E with two magnification levels (15× vs. 120×). The addition of crimped fiber can reduce density significantly. This can be seen again in FIGS. 4A-4F, which show a series of cross-sectional SEM pictures for Codes C, D, and E with two magnification levels (15× vs. 120×). In these cross-sectional pictures, one can see both the density of the sheets and also the bulk or thickness of the materials. As the density of the sheet is reduced from Codes C to D due to presence of a crimped fiber, its thickness is also increased. Note that Code D has a much lower basis weight than Code C (90 vs. 140 gsm). If they were at the same basis weight, Code D should be much thicker or have more bulk than Code C.

In further experiments, a foam-forming pilot line trial was conducted to study the effect of both a crimped fiber's chemistry and physical structure on web caliper and density of a foam-formed fibrous sheet. Thirteen samples were produced that included seven different crimped fibers from fiber vendors. Crimped fiber variables included (1) Polymer Types, (2) Fiber Lengths, and (3) Fiber Diameters (refer to Table 2 for detailed fiber chemical and physical parameters).

TABLE 1

Foam-formed Codes Produced in Both Bench Study and Pilot Line Trials

| | | Fiber Composition | | | Slurry Composition | | Drying | | Curing | | Sheet Property | | |
|---|---|---|---|---|---|---|---|---|---|---|---|---|---|
| Code | Process | 1st Fiber | 2nd Fiber | 3rd Fiber | Surfactant | Consistency | Temp | Time | Temp | Time | Density (g/cc) | % Density | Basis Weight (gms) |
| A | Bench w/high speed mixer | 60% LL 19[a] | 30% PET 6 mm[b] | 10% T 255[c] | 0.13 wt % SDS | 4% | 90° C. | 3 hours | 130° C. | 50 min | 0.017 | | 121 |
| B | Bench w/high speed mixer | 60% LL 19 | 30% PET 5 mm crimped[d] | 10% T 255 | 0.13 wt % SDS | 4% | 90° C. | 3 hours | 130° C. | 50 min | 0.019 | 11.8 | 124 |
| C | Pilot line | 60% LL 19 | 20% PET 20 mm[e] | 20% T 255 | 0.15 vol % Triton | 3% | Continuous drying and curing in two heating zones | | | | 0.091 | | 140 |
| D | Pilot line | 60% LL 19 | 20% PET 6.3 mm crimped fiber[f] | 20% T 255 | 0.15 vol % Triton | 3% | Continuous drying and curing in two heating zones | | | | 0.048 | −47.3 | 90 |
| E | Pilot line | 0% LL 19 | 80% PET 6.3 mm crimped fiber | 20% T 255 | 0.15 vol % T riton | 3% | Continuous drying and curing in two heating zones | | | | 0.03 | −67.0 | 108 |

Notes:

[a]LL 19 is a NSWK wood pulp fiber

[b]A PET staple fiber with 6 mm fiber length

[c]T 255 is a bicomponent binder fiber produced by Trevira with a fiber length of 6 mm and a fiber diameter of 2.2 dtex

[d]A polyester crimped staple fiber with a fiber length of 5 mm and produced by MiniFiber Inc.

[e]A PET staple fiber with a 20 mm fiber length

[f]A crimped PET staple fiber, P60FMCR, with a 5 denier & ¼ inch fiber length and produced by Barnet

TABLE 2

Fibers Used for the Foam-forming Trials

| Fiber | Manufacturer | Fiber Polymer Chemistry: Polymer | Fiber Polymer Chemistry: Tg (°C) | Fiber Parameter: Fiber Length (mm) | Fiber Parameter: Fiber Diameter (denier*) | Fiber Parameter: Crimped Structure |
|---|---|---|---|---|---|---|
| NSBK LL-19 | Terrace Bay, Canada | Cellulose Wood Pulp | NA | 2 | 20 μm | No |
| T 255-6 (sheath/core shaped) | Trevira | PE/PET | −125/69 | 6 | 2 | Yes |
| PET 6 mm | William Barnet & Son | PET | 69 | 6 | 3 | No |
| P60FMCR | Barnet | PET | 69 | 6.35 | 6.5 | Yes |
| PSCRP-060NRR-0600 | MiniFiber Inc. | PET | 69 | 6.35 | 6 | Yes |
| FIT Curled (Bowtie Shaped) | Fiber Innovation Technology | PTT/PET | 45/69 | 12.2 | 6 | Yes |
| ACCRN-1504RR-5150 | MiniFiber Inc. | Acrylic | 104 | 25.4 | 15 | Yes |
| ACCRN-0154RR-0650 | MiniFiber Inc. | Acrylic | 104 | 6.35 | 1.5 | Yes |
| NYBCF-120WRR-0600 | MiniFiber Inc. | Nylon | 50 | 6.35 | 12 | Yes |
| PELPE-060NLR-060C | MiniFiber Inc. | PE | −125 | 6.35 | 6 | Yes |

Note:
Tg data were referenced by Misumi Technical Tutorial (www.misumi-techcentral.com/tt/en/mold/2011/12/106-glass-transition-temperature-tg-of-plastics.html)
*Fiber diameter conversion: 1 dtex equals to 0.9 denier Examples 1-13 in Table 3: The slurries used to form the expanded foams included Triton X-100 as the surfactant. The solids included a combination of a NSBK (Northern Softwood Bleached Kraft) wood pulp fiber, such as LL-19; a synthetic staple fiber having a crimped or non-crimped structure; and the binder fiber Trevira T-255-6 polyethylene/PET sheath/core staple fiber with a 6 mm fiber length and 2 denier fiber diameter. The synthetic staple fibers used have different polymer chemistries and fiber dimensions. These examples were produced on a pilot line. The NBSK wood pulp fiber was pulped in 250 liters of water in a couch pulper. A batch of foam was prepared in the main pulper with the addition of Triton X-100 such that the total system volume (including contents of the couch pulper) would become 4,440 liters of foam with an air content of about 64% of the total volume. The synthetic staple fiber and the binder fiber T-255 were added to the main pulper; this thickstock was supplied to the headbox of a Fourdrinier paper machine at 150 L/minute. The total fiber consistency was 0.45 wt % with the surfactant solid level in the fibrous slurry at 0.15 wt %. A web was formed and allowed to returning to the main pulper via the couch pulper. The NBSK was thus purged from the couch pulper and introduced to the main pulper to complete the furnish. This system was run in closed loop manner for approximately 10 minutes to allow for thickstock and thinstock consistencies, and to allow the grammage to equilibrate. Once it was evident from the control system that the process was stable, the web was taken through a two-zone, electrically heated, through-air dryer. The system was switched from closed loop operation and the excess foam sent to drain such that the thickstock consistency remained constant and the pulper contents were run out. The air temperature in Zone 1 was set to dry the web. The air temperature in Zone 2 was set to 'activate' the bi-component binder fiber to partially melt and bond the fiber matrix together. The dryer conditions were: Zone 1 temperature at 170 to 180° C. and Zone 2 temperature at 150 to 170° C. with the fan speed about 50 to 70%. The products were targeted to achieve a basis weight of 100 gsm. The dry sample was cut into a 10 inch by 10 inch sheet and measured its weight and caliper. The basis weight and density of each product were calculated from the measured values. It was found that when a crimped fiber was effective to generate high bulk, its caliper increased while density reduced. We can use density reduction to define our invention. The density reduction is calculated using the equation below:

$$\text{Density Change}=(D_{crimped}-D_{non\text{-}crimped})/D_{non\text{-}crimped}\times 100\%$$

where $D_{crimped}$ and $D_{non\text{-}crimped}$ represent web densities of one with a crimped fiber and a non-crimped fiber respectively. Both webs need to contain the same amount of the other fibers. The only difference between the two webs is that one includes a crimped fiber while the other includes a non-crimped fiber.

RESULTS

Referring to polymer type in Table 3, a wide range of different polymer types of crimped fibers from PET, nylon, acrylic, PTT/PET, and PE were run. A crimped fiber is preferably made of a "stiff" polymer in to be effective to generate bulk. For example, when a crimped fiber made of polyethylene polymer (PE), even though it has a fiber diameter of 6 deniers and is therefore thick enough, the PE fiber lacks the capability to generate bulk due to its softness, especially at an elevated temperature during the process (refer to Code 8 in Table 3). Fiber softness or stiffness can be defined using the fiber's glass transition temperature, Tg. The higher the Tg, the more stiff the polymer or fiber is. In general, a suitable crimped fiber should be made from a polymer having a Tg equal to or greater than 0° C. PE has a Tg of −125° C., while PP has a Tg of 0° C.

In addition, crimped fibers having a wide range of fiber lengths from 6 mm to 60 mm were used. The pilot line, however, could only handle fibers with lengths less than 30 mm. As a result, the upper limit of useful fiber lengths was not determined. Crimped fibers up to 60 mm, however, should be usable if they can be uniformly dispersed in a foam-formed fibrous sheet, and should be able to generate bulk.

Further, experimentation with different fiber diameters determined that fiber diameter is a key variable. Crimped fibers with a diameter less than 3 deniers were found to be ineffective in terms of bulk enhancement. Therefore, not all crimped fibers, even those with a Tg above 0° C., are effective in delivering the desired bulk enhancement. For example, in a comparison between Codes 5 and 6 in Table 3, a crimped acrylic fiber having a 15 deniers fiber diameter was more effective to generate wet bulk (or reduce web density) than the fiber having only a 1.5 deniers fiber diameter.

Finally, the crimped structure was varied in the experiments. The bulk enhancement benefit in a foam-formed fibrous sheet including a crimped fiber as opposed to one including a non-crimped fiber was determined. Two fibrous web compositions were used: (1) a web containing only 20% crimped fiber vs. 20% non-crimped fiber, and (2) a web containing 80% crimped fiber vs. 80% non-crimped fiber. In general, the greater the proportion of crimped content used, the higher the enhancement in caliper or the more the reduction in density of the fibrous sheet can be seen.

TABLE 3

Properties of Foam-formed Fibrous Sheets

| Code | Fiber Types & Dry Fiber Weight Ratio | | | | | | Foam-formed Fibrous Web Properties | | | |
|---|---|---|---|---|---|---|---|---|---|---|
| # | Fiber 1 | Weight % | Fiber 2 | Weight % | Fiber 3 | Weight % | Basis Weight (gsm) | Caliper (mm) | Density (g/cc) | Density Change* |
| 1 | LL-19 | 60% | PET 6 mm | 20% | T 255-6 | 20% | 111 | 0.65 | 0.171 | |
| 2 | LL-19 | 60% | P60FMCR | 20% | T 255-6 | 20% | 101 | 1.35 | 0.075 | −56.1% |
| 3 | LL-19 | 60% | PSCRP-060NRR-0600 | 20% | T 255-6 | 20% | 90 | 1.32 | 0.068 | −60.2% |
| 4 | LL-19 | 60% | FIT Curled | 20% | T 255-6 | 20% | 104 | 1.5 | 0.069 | −59.6% |
| 5 | LL-19 | 60% | ACCRN-1504RR-5150 | 20% | T 255-6 | 20% | 85 | 1.05 | 0.081 | −52.6% |
| 6 | LL-19 | 60% | ACCRN-0154RR-0650 | 20% | T 255-6 | 20% | 98 | 0.78 | 0.126 | −26.3% |
| 7 | LL-19 | 60% | NYBCF-120WRR-0600 | 20% | T 255-6 | 20% | 90 | 1.05 | 0.086 | −49.7% |
| 8 | LL-19 | 60% | PELPE-060NLR-060C | 20% | T 255-6 | 20% | 92 | 0.65 | 0.142 | −16.9% |
| 9 | | | PET 6 mm | 70% | T 255-6 | 30% | 96 | 0.8 | 0.120 | |
| 10 | | | P60FMCR | 70% | T 255-6 | 30% | 95 | 2.42 | 0.039 | −67.5% |
| 11 | | | FIT Curled | 70% | T 255-6 | 30% | 87 | 2.15 | 0.040 | −66.7% |
| 12 | | | PSCRP-060NRR-0600 | 70% | T 255-6 | 30% | 85 | 2.25 | 0.038 | −68.3% |
| 13 | | | NYBCF-120WRR-0600 | 70% | T 255-6 | 30% | 95 | 1.62 | 0.059 | −50.8% |

*Density Change = (Density of Web − Density of Control Web)/Density of Control Web × 100%.

In a first particular aspect, a method for producing a high-bulk, foam-formed substrate includes producing an aqueous-based foam including at least 1% by weight crimped synthetic fibers and at least 1% by weight binder fibers; forming a wet sheet from the aqueous-based foam; and drying the wet sheet to obtain the foam-formed substrate.

A second particular aspect includes the first particular aspect, wherein the foam-formed substrate has a dry density between 0.02 g/cc and 0.1 g/cc.

A third particular aspect includes the first and/or second aspect, wherein the crimped synthetic fibers have a length from 5 mm to 60 mm.

A fourth particular aspect includes one or more of aspects 1-3, wherein the crimped synthetic fibers have a length from 5 mm to 30 mm.

A fifth particular aspect includes one or more of aspects 1-4, wherein the crimped synthetic fibers have a diameter of at least 4 dtex.

A sixth particular aspect includes one or more of aspects 1-5, wherein the crimped synthetic fibers have a three-dimensional kinked or curly structure.

A seventh particular aspect includes one or more of aspects 1-6, wherein the crimped synthetic fibers include a polymer having a Tg greater than or equal to 0° C.

An eighth particular aspect includes one or more of aspects 1-7, wherein the foam-formed substrate exhibits at least a 30% reduction in density compared to the same foam-formed substrate with non-crimped fiber replacing the crimped fiber.

A ninth particular aspect includes one or more of aspects 1-8, wherein producing includes at least 2% by weight crimped synthetic fibers and at least 2% by weight binder fibers.

A tenth particular aspect includes one or more of aspects 1-9, wherein producing includes at least 5% by weight crimped synthetic fibers and at least 5% by weight binder fibers.

An eleventh particular aspect includes one or more of aspects 1-10, wherein the foam-formed substrate is free of superabsorbent material.

A twelfth particular aspect includes one or more of aspects 1-11, wherein the crimped fiber has a fiber length from 5 to 30 mm, a fiber diameter of at least 4 dtex, and include a polymer having a Tg greater than or equal to 0° C.

In a thirteenth particular aspect, a substrate includes an aqueous-based polymer foam including at least 1% by weight crimped synthetic fiber and at least 1% by weight binder fiber, wherein the substrate is free of superabsorbent material.

A fourteenth particular aspect includes the thirteenth particular aspect, wherein the substrate has a dry density between 0.02 g/cc and 0.1 g/cc.

A fifteenth particular aspect includes the thirteenth and/or fourteenth particular aspects, wherein the crimped synthetic fibers have a length from 5 mm to 30 mm.

A sixteenth particular aspect includes one or more of aspects 13-15, wherein the crimped synthetic fibers have a diameter of at least 4 dtex.

A seventeenth particular aspect includes one or more of aspects 13-16, wherein the crimped synthetic fibers include a polymer having a Tg greater than or equal to 0° C.

An eighteenth particular aspect includes one or more of aspects 13-17, wherein the crimped fiber has a fiber length from 5 to 30 mm, a fiber diameter of at least 4 dtex, and include a polymer having a Tg greater than or equal to 0° C.

A nineteenth particular aspect includes one or more of aspects 13-18, wherein producing includes at least 2% by weight crimped synthetic fibers and at least 2% by weight binder fibers.

In a twentieth particular aspect, a method for producing a high-bulk, foam-formed substrate includes producing an aqueous-based foam including at least 2% by weight crimped binder fibers; forming a wet sheet from the aqueous-based foam; and drying the wet sheet to obtain the foam-formed substrate, wherein the foam-formed substrate is free of superabsorbent material, and wherein the substrate has a dry density between 0.02 g/cc and 0.1 g/cc.

These and other modifications and variations to the present disclosure can be practiced by those of ordinary skill in the art, without departing from the spirit and scope of the present disclosure, which is more particularly set forth in the appended claims. In addition, it should be understood that aspects of the various aspects of the present disclosure may be interchanged either in whole or in part. Furthermore, those of ordinary skill in the art will appreciate that the foregoing description is by way of example only, and is not intended to limit the disclosure so further described in such appended claims.

What is claimed:

1. A method for producing a foam-formed substrate, the method comprising:

producing an aqueous-based foam including at least 1% by weight crimped synthetic fibers and at least 1% by weight binder fibers; wherein the crimped synthetic fibers include a polymer having a Tg greater than or equal to 0° C., have a length from 5 mm to 60 mm, and have a diameter of at least 3 dtex;

forming a wet sheet from the aqueous-based foam; and drying the wet sheet to obtain the foam-formed substrate;

wherein the foam-formed substrate has a dry density between 0.02 g/cc and 0.1 g/cc.

2. The method of claim 1, wherein the crimped synthetic fibers have a length from 5 mm to 30 mm.

3. The method of claim 1, wherein the crimped synthetic fibers have a diameter of at least 4 dtex.

4. The method of claim 1, wherein the crimped synthetic fibers have a three-dimensional kinked or curly structure.

5. The method of claim 1, wherein the foam-formed substrate exhibits at least a 30% reduction in density compared to the same foam-formed substrate with non-crimped fiber replacing the crimped synthetic fibers.

6. The method of claim 1, wherein producing includes at least 2% by weight crimped synthetic fibers and at least 2% by weight binder fibers.

7. The method of claim 1, wherein producing includes at least 5% by weight crimped synthetic fibers and at least 5% by weight binder fibers.

8. The method of claim 1, wherein the foam-formed substrate is free of superabsorbent material.

9. The method of claim 1, wherein the crimped synthetic fibers have a fiber length from 5 to 30 mm and a fiber diameter of at least 4 dtex.

10. A substrate comprising an aqueous-based polymer foam including at least 1% by weight crimped synthetic fibers and at least 1% by weight binder fibers, wherein the substrate is free of superabsorbent material; wherein the crimped synthetic fibers include a polymer having a Tg greater than or equal to 0° C., have a length from 5 mm to 60 mm, and have a diameter of at least 3 dtex; and wherein the foam-formed substrate has a dry density between 0.02 g/cc and 0.1 g/cc.

11. The substrate of claim 10, wherein the crimped synthetic fibers have a length from 5 mm to 30 mm.

12. The substrate of claim 10, wherein the crimped synthetic fibers have a diameter of at least 4 dtex.

13. The substrate of claim 10, wherein the crimped synthetic fibers have a fiber length from 5 to 30 mm and a fiber diameter of at least 4 dtex.

14. The substrate of claim 10, wherein producing includes at least 2% by weight crimped synthetic fibers and at least 2% by weight binder fibers.

* * * * *